US009720374B2

(12) United States Patent
Kanno et al.

(10) Patent No.: US 9,720,374 B2
(45) Date of Patent: Aug. 1, 2017

(54) CARTRIDGE, IMAGE FORMING APPARATUS AND MANUFACTURING METHOD OF THE CARTRIDGE

(71) Applicant: CANON KABUSHIKI KAISHA, Tokyo (JP)

(72) Inventors: Kazuhiko Kanno, Odawara (JP); Yuichi Fukui, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/042,585

(22) Filed: Feb. 12, 2016

(65) Prior Publication Data

US 2016/0238993 A1 Aug. 18, 2016

(30) Foreign Application Priority Data

Feb. 16, 2015 (JP) ..... 2015-027451

(51) Int. Cl.
*G03G 21/18* (2006.01)
*G03G 15/08* (2006.01)

(52) U.S. Cl.
CPC ..... *G03G 21/1885* (2013.01); *G03G 15/0863* (2013.01); *G03G 21/181* (2013.01); *G03G 2215/0697* (2013.01); *G03G 2221/1823* (2013.01)

(58) Field of Classification Search
CPC ..... G03G 15/0863; G03G 21/1875–21/1885; G03G 2215/0697; G03G 2221/1823
See application file for complete search history.

(56) References Cited

U.S. PATENT DOCUMENTS

| | | | |
|---|---|---|---|
| 5,729,796 | A | 3/1998 | Miura et al. |
| 5,768,658 | A | 6/1998 | Watanabe et al. |
| 5,815,644 | A | 9/1998 | Nishiuwatoko et al. |
| 5,870,655 | A | 2/1999 | Nishiuwatoko et al. |
| 5,893,006 | A | 4/1999 | Kanno et al. |
| 5,926,666 | A | 7/1999 | Miura et al. |
| 5,937,239 | A | 8/1999 | Watanabe et al. |
| 5,937,240 | A | 8/1999 | Kanno et al. |

(Continued)

FOREIGN PATENT DOCUMENTS

| | | | |
|---|---|---|---|
| JP | 2003-195728 | A | 7/2003 |
| JP | 2006-293003 | A | 10/2006 |

*Primary Examiner* — David M Gray
*Assistant Examiner* — Carla Therrien
(74) *Attorney, Agent, or Firm* — Fitzpatrick, Cella, Harper & Scinto

(57) ABSTRACT

A cartridge used for forming an image on a recording material includes a memory for storing information, wherein the memory has an outer configuration having a length in a first direction and a length in a second direction longer than the length in the first direction in a plane crossing a thickness direction thereof; a supporting portion provided on a first cartridge constituent member and provided with a slit for permitting insertion of the memory; and a preventing portion, provided on a second cartridge constituent member, for preventing movement of the memory inserted in the supporting portion. A prevention width of the slit with respect to a direction crossing the thickness direction of the memory is longer than the length of the memory in the first direction and is shorter than the length of the memory in the second direction as seen in an inserting direction of the memory.

16 Claims, 15 Drawing Sheets

(56) References Cited

U.S. PATENT DOCUMENTS

| | | | | |
|---|---|---|---|---|
| 5,940,657 | A | 8/1999 | Yokomori et al. | |
| 5,950,049 | A | 9/1999 | Yokomori et al. | |
| 6,070,029 | A | 5/2000 | Nishiuwatoko et al. | |
| 6,072,969 | A | 6/2000 | Yokomori et al. | |
| 6,345,164 | B1 | 2/2002 | Yokomori et al. | |
| 6,381,430 | B1 | 4/2002 | Yokomori et al. | |
| 6,496,667 | B2 | 12/2002 | Shiratori et al. | |
| 6,516,168 | B2 | 2/2003 | Shiratori et al. | |
| 6,560,422 | B2 | 5/2003 | Kanno et al. | |
| 6,681,088 | B2 | 1/2004 | Kanno et al. | |
| 6,735,403 | B2 | 5/2004 | Kanno et al. | |
| 6,834,173 | B2 | 12/2004 | Yamaguchi et al. | |
| 6,937,834 | B2 | 8/2005 | Kanno et al. | |
| 6,947,687 | B2 | 9/2005 | Yamaguchi et al. | |
| 6,961,528 | B2 | 11/2005 | Yamaguchi et al. | |
| 6,980,759 | B2 | 12/2005 | Kanno et al. | |
| 7,058,337 | B2 | 6/2006 | Hashimoto et al. | |
| 7,184,686 | B2 | 2/2007 | Kanno et al. | |
| 7,450,877 | B2 | 11/2008 | Miyabe et al. | |
| 7,463,844 | B2 | 12/2008 | Hashimoto et al. | |
| 7,702,251 | B2 | 4/2010 | Miyabe et al. | |
| 7,756,441 | B2 | 7/2010 | Kanno et al. | |
| 7,929,881 | B2 | 4/2011 | Yoshino et al. | |
| 7,933,534 | B2 | 4/2011 | Hoshi et al. | |
| 7,945,185 | B2 | 5/2011 | Miyabe et al. | |
| 8,059,988 | B2 | 11/2011 | Kanno et al. | |
| 8,090,292 | B2 | 1/2012 | Kanno et al. | |
| 8,155,554 | B2 | 4/2012 | Miyabe et al. | |
| 8,155,557 | B2 | 4/2012 | Kanno et al. | |
| 8,170,444 | B2 | 5/2012 | Kanno et al. | |
| 8,170,445 | B2 | 5/2012 | Kanno et al. | |
| 8,385,775 | B2 | 2/2013 | Kanno et al. | |
| 8,437,661 | B2 | 5/2013 | Kanno et al. | |
| 8,494,399 | B2 | 7/2013 | Miyabe et al. | |
| 8,494,410 | B2 | 7/2013 | Kanno et al. | |
| 8,577,252 | B2 | 11/2013 | Anan et al. | |
| 8,682,211 | B2 | 3/2014 | Hoshi et al. | |
| 8,805,237 | B2 | 8/2014 | Kanno et al. | |
| 8,879,944 | B2 | 11/2014 | Takarada et al. | |
| 8,879,954 | B2 | 11/2014 | Nonaka et al. | |
| 8,909,096 | B2 | 12/2014 | Fukui et al. | |
| 8,983,335 | B2 | 3/2015 | Yamashita et al. | |
| 9,025,998 | B2 | 5/2015 | Morioka et al. | |
| 9,052,640 | B2 | 6/2015 | Kashiide et al. | |
| 9,188,940 | B2 | 11/2015 | Fukui et al. | |
| 9,213,267 | B2 | 12/2015 | Hoshi et al. | |
| 9,274,489 | B2 | 3/2016 | Takarada et al. | |
| 9,274,499 | B2 | 3/2016 | Morioka et al. | |
| 2005/0095017 | A1* | 5/2005 | Kikuchi | G03G 21/1889 399/12 |
| 2006/0228127 | A1 | 10/2006 | Miyabe et al. | |
| 2008/0003014 | A1* | 1/2008 | Martin | B41J 2/17546 399/109 |
| 2014/0086597 | A1* | 3/2014 | Tanabe | G03G 21/1867 399/12 |
| 2014/0212151 | A1* | 7/2014 | Oda | G03G 15/0863 399/12 |
| 2014/0294447 | A1* | 10/2014 | Ishiguro | G03G 15/0863 399/258 |
| 2014/0314445 | A1 | 10/2014 | Kanno et al. | |
| 2014/0341606 | A1* | 11/2014 | Fujii | G03G 15/0863 399/90 |
| 2014/0361030 | A1 | 12/2014 | Toba et al. | |
| 2015/0037065 | A1 | 2/2015 | Takarada | |
| 2015/0055963 | A1 | 2/2015 | Kanno et al. | |
| 2015/0093146 | A1 | 4/2015 | Sato et al. | |
| 2015/0227085 | A1 | 8/2015 | Kashide et al. | |
| 2016/0238967 | A1* | 8/2016 | Fukui | G03G 21/1885 |

* cited by examiner

CARTRIDGE, IMAGE FORMING APPARATUS AND MANUFACTURING METHOD OF THE CARTRIDGE

FIELD OF THE INVENTION AND RELATED ART

The present invention relates to a cartridge detachably mountable to an apparatus main assembly of an image forming apparatus for forming an image on a recording material. Further, the present invention relates to the image forming apparatus, to which the cartridge is detachably mountable, for forming the image on the recording material.

An electrophotographic image forming apparatus, such as a printer, using an electrophotographic process electrically charges uniformly the electrophotographic photosensitive member as the image bearing member and then forms a latent image by selective exposure of the electrophotographic photosensitive member to light. Then, the latent image is developed with the developer to be visualized as a developer image. The developer image is then transferred onto a recording material (medium), and by applying heat and pressure to the transferred developer image, the developer image is fixed on the recording material, so that an image is recorded.

Such a conventional electrophotographic image forming apparatus was accompanied with supply of the developer and maintenance of various process devices.

As a means for facilitating such a developer supplying operation and maintenance, all or a part of the electrophotographic photosensitive member, a charging means, the developing means, a cleaning means and the like are integrally assembled, as a cartridge, in a frame. A cartridge type in which the cartridge is detachably mountable to the electrophotographic image forming apparatus is employed.

According to the cartridge type, the maintenance of the image forming apparatus can be performed in the form of replacement of the process cartridge or the developing device by a user himself (herself), and therefore it was possible to remarkably improve productivity, so that the cartridge type has been widely used in the electrophotographic image forming apparatus.

In such a cartridge, there is a cartridge on which a memory (IC memory or the like) for storing information of the cartridge. When the cartridge is mounted in the apparatus main assembly, it is possible to transfer the information between the apparatus main assembly and the cartridge. A constitution in which a state such as an operation status of the cartridge is notified to a controller of the apparatus main assembly has been proposed (U.S. Pat. No. 5,937,239).

In the memory mounted on the cartridge, pieces of insert on characteristics of the image forming apparatus and the process means and the like are registered. As a result, maintenance of the apparatus main assembly or the cartridge can be facilitated. Further, control of image formation is effected depending on the information stored in the memory. As a result, the image formation can be carried out under a best condition.

As a fixing method of the memory on the cartridge, various methods have been known. For example, there is a method such that the memory is fixed to a frame of the cartridge by a double-side tape or the like. This method is effective in the case where a relatively broad area can be ensured as a bonding surface. Further, a method such that the memory is directly formed by insert molding has been known. There is also a method such that a frame of the cartridge is provided with an opening and a guide (portion) and then a memory is slid and inserted through the opening (Japanese Laid-Open Patent Application (JP-A) 2006-293003 and JP-A 2003-195728). In this method, movement of the memory is prevented by the opening and the guide, and therefore the memory can be easily mounted to the frame.

In conventional examples described above, the memory was fixed to the cartridge by forming a retaining portion such that the opening is covered by a projected portion which is provided at an end portion of the opening and then is melted by thermal caulking. The projected portion is provided in the neighborhood of a cartridge electrical contact provided on the memory in order to electrically connect the memory with the apparatus main assembly of the electrophotographic image forming apparatus, and when the projected portion is melted by the thermal caulking or the like, there was a possibility that the retaining portion covers the cartridge electrical contact.

For this reason, in the conventional examples, the above problem has been solved by increasing a size of the memory in order to ensure a margin by increasing a distance between the projected portion and the electrical contact, and by managing a manufacturing condition of the thermal caulking or the like.

SUMMARY OF THE INVENTION

In view of the circumstances described above, the present invention is a further development of the prior art. A principal object of the present invention is to provide a cartridge capable of downsizing a memory.

Another object of the present invention is to provide an image forming apparatus using the cartridge.

A further object of the present invention is to provide a manufacturing method of the cartridge.

According to an aspect of the present invention, there is provided a cartridge used for forming an image on a recording material, comprising: a memory for storing information, wherein the memory has an outer configuration having a length in a first direction and a length in a second direction longer than the length in the first direction in a plane crossing a thickness direction thereof; a supporting portion provided on a first cartridge constituent member and provided with a slit for permitting insertion of the memory; and a preventing portion, provided on a second cartridge constituent member, for preventing movement of the memory inserted in the supporting portion, wherein a prevention width of the slit with respect to a direction crossing the thickness direction of the memory is longer than the length of the memory in the first direction and is shorter than the length of the memory in the second direction as seen in an inserting direction of the memory.

According to another aspect of the present invention, there is provided a cartridge used for forming an image on a recording material, comprising: a memory, provided with a plurality of electrical contacts, for storing information; a supporting portion provided on a first cartridge constituent member and provided with a slit for permitting insertion of the memory; and a preventing portion, provided on a second cartridge constituent member, for preventing movement of the memory inserted in the supporting portion, wherein the plurality of electrical contacts are provided and arranged along a longitudinal direction of the cartridge.

According to another aspect of the present invention, there is provided an image forming apparatus including the cartridge.

According to a further aspect of the present invention, there is provided a manufacturing method of a cartridge used for forming an image on a recording material including, a memory for storing information, wherein the memory has an outer configuration having a length in a first direction and a length in a second direction longer than the length in the first direction in a plane crossing a thickness direction thereof; a supporting portion provided on a first cartridge constituent member and provided with a slit for permitting insertion of the memory; and a preventing portion, provided on a second cartridge constituent member, for preventing movement of the memory inserted in the supporting portion, wherein a prevention width of the slit with respect to a direction crossing the thickness direction of the memory is longer than the length of the memory in the first direction and is shorter than the length of the memory in the second direction as seen in an inserting direction of the memory, the manufacturing method comprising: inserting the memory into the slit; and assembling the first and second cartridge constituent member with each other.

Further features of the present invention will become apparent from the following description of exemplary embodiments with reference to the attached drawings.

DESCRIPTION OF THE PREFERRED EMBODIMENTS

Figure 1:
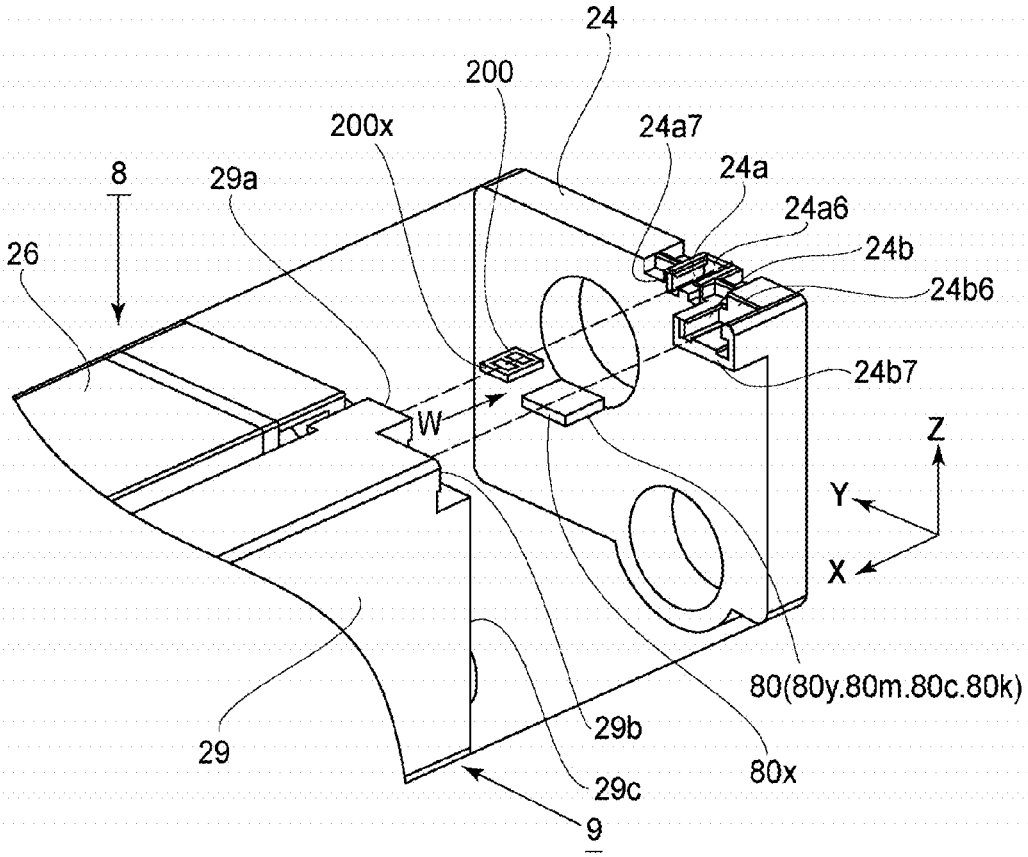
FIG. 1 is an exploded perspective view of a principal part of a cartridge in First Embodiment.

In the following, embodiments of the present invention will be specifically described with reference to the drawings.

[First Embodiment]

(Image Forming Apparatus)

A cartridge and an image forming apparatus using the cartridge according to First Embodiment of the present invention will be described with reference to the drawings.

In this embodiment, as an electrophotographic image forming apparatus, a full-color electrophotographic image forming apparatus to which four process cartridges are detachably mountable is described as an example.

Further, in this embodiment, as an example of the image forming apparatus, a printer is exemplified. However, the image forming apparatus is not limited to the printer. The present invention is also applicable to, e.g., other image forming apparatuses such as a copying machine, a facsimile machine and a multi-function machine having functions of these machines in combination.

The image forming apparatus forms an image on a recording material by using an image forming process such as an electrophotographic image forming type, an electrostatic image forming type or a magnetic recording image forming type. Examples of the image forming apparatus may include a copying machine, a printer (a laser beam printer, an LED printer or the like), a facsimile machine, a multi-function machine having functions of these machines, a word processor, and so on.

The recording material is a material on which the image is to be formed by the image forming apparatus, and includes, e.g., paper, an OHP sheet, an intermediary transfer member and an image display member of the image forming apparatus.

<General Structure of Image Forming Apparatus>

First, an image forming apparatus 1 according to the present invention will be described with reference to FIG. 2 which is a schematic sectional view.

An image forming apparatus 1 is a four color-based full-color laser printer using the electrophotographic image forming process and effects color image formation on a recording material S based on image information (electrical image signal) inputted from an external host device 300 to a contact circuit portion (control means or a controller) 100. The external host device 300 is a personal computer, an image reader, a facsimile, a network or the like.

The image forming apparatus 1 is of a process cartridge type in which in a state in which the cartridge contributing to an image forming process is detachably mounted, an image is formed on the recording material S. In this embodiment, as cartridges, four process cartridges P (PY, PM, PC, PK) are detachably mounted to an apparatus main assembly 2, and a color image is formed on the recording material S.

Here, with respect to the image forming apparatus 1, the side (surface) on which an apparatus openable door 3 is provided is referred to as a front side (surface), and a side (surface) opposite to the front side (surface) is referred to as a rear side (surface). Further, a right side when the image forming apparatus 1 is viewed from the front surface is referred to as a driving side, and a left side is referred to as a non-driving side.

Inside the apparatus main assembly 2, the four cartridges P consisting of the first cartridge PY, the second cartridge PM, the third cartridge PC and the fourth cartridge PK are provided and arranged in a horizontal direction. The respective first to fourth cartridges P have the same electrophotographic process mechanism but contains developers (toners) different in color from one another. To the cartridges P, a rotational driving force is transmitted from a drive output portion (not shown) of the apparatus main assembly 2. Further, to the cartridges P, bias voltages (charging bias, developing bias and the like) are supplied from the apparatus main assembly 2 (not shown).

Figure 3:
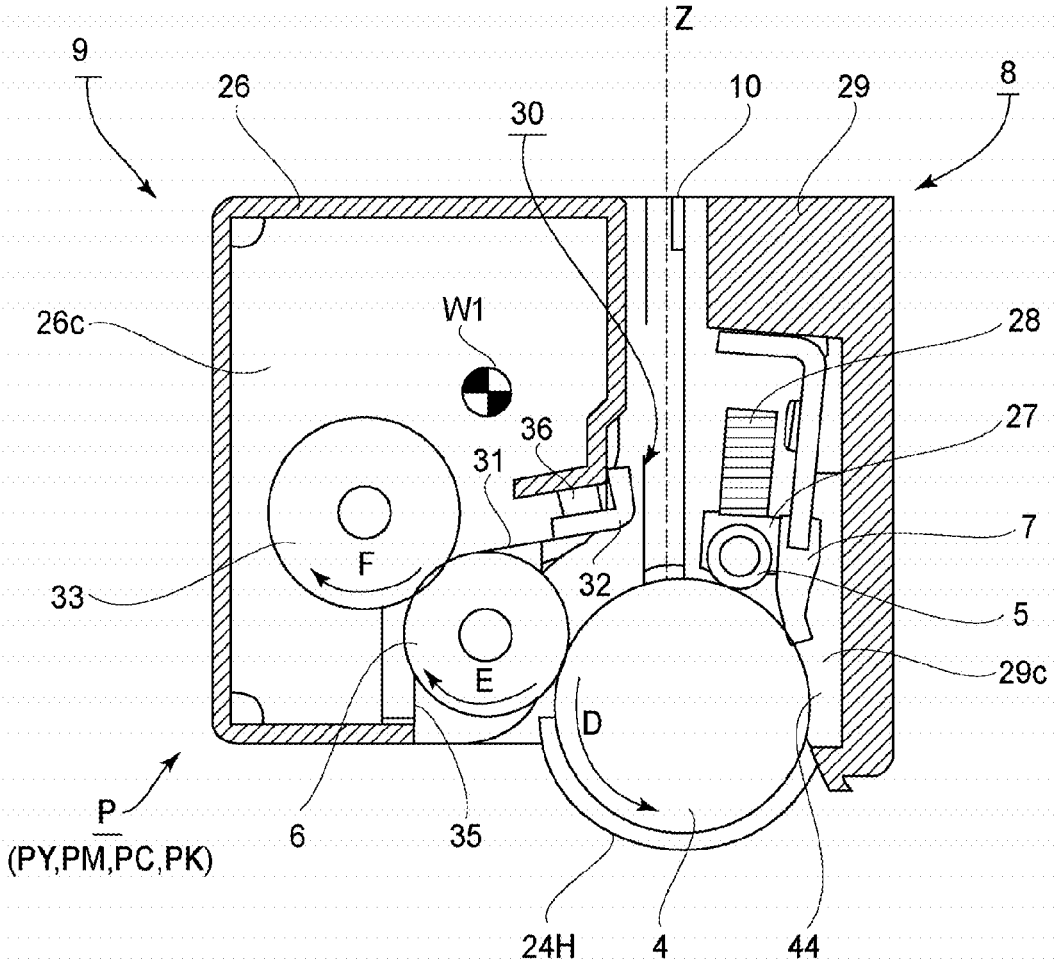
FIG. 3 is a schematic cross-sectional view of the cartridge.

Each of the cartridges P is a process cartridge of an integral type, and as shown in FIG. 3, includes a cleaning unit 8 and a developing device 9. The developing device 9 is connected swingably about a shaft W1 relative to the cleaning unit 8.

The cleaning unit 8 includes a drum type electrophotographic photosensitive member (photosensitive drum) 4 as a rotatable image bearing member on which a latent image is to be formed, and a charging means 5 and a cleaning means 7 which are actable, as process means, on the photosensitive drum 4. As the charging means 5, a charging roller which is a contact charging member. As the cleaning means 7, a cleaning blade is used.

The developing device 9 is a contact developing device using a one-component non-magnetic developer (toner), and includes a developing (device) frame 26 and a developer carrying member (developing roller) as a developing means 6 provided relative to the developing frame 26. The developing frame 26 includes a developer accommodating chamber (developer accommodating portion) 26*c* in which the toner is accommodated.

The first cartridge PY accommodates the toner of yellow (Y) in its developer accommodating chamber 26*c* and forms the toner image of yellow on the surface of the photosensitive drum 4. The second cartridge PM accommodates the toner of magenta (M) in its developer accommodating chamber 26*c* and forms the image of magenta on the surface of the photosensitive drum 4. The third cartridge PC accommodates the toner of cyan (C) in its developer accommodating chamber 26*c* and forms the toner image of cyan on the surface of the photosensitive drum 4. The fourth cartridge PK accommodates the toner of black (K) in its developer accommodating chamber 26*c* and forms the toner image of black on the surface of the photosensitive drum 4.

Above the four cartridges P, a laser scanner unit LB as an exposure means is provided. This laser scanner unit LB outputs laser light Z correspondingly to image information. Then, the laser light Z passes through an exposure window portion 10 of each cartridge P, so that the surface of the photosensitive drum 4 is subjected to scanning exposure to the laser light Z.

Under the four cartridges P, an intermediary transfer belt unit 11 as a transfer member is provided. This intermediary transfer belt unit 11 includes a driving roller 13, a turn roller 14 and a tension roller 15, and includes a flexible endless transfer belt 12 extended and stretched by the rollers.

The photosensitive drum 4 of each of the four cartridges P is contacted to an upper surface of the transfer belt 12 at its lower surface. A resultant contact portion is a primary transfer portion. Inside the transfer belt 12, primary transfer rollers 16 are provided opposed to the associated photosensitive drums 4. Oppositely to the turn roller 14, a secondary transfer roller 17 is provided in contact with the transfer belt 12. A resultant contact portion between the transfer belt 12 and the secondary transfer roller 17 is a secondary transfer portion.

Below the intermediary transfer belt unit 11, a sheet feeding unit 18 is provided. This sheet feeding unit 18 includes a sheet feeding tray 19 in which sheets of the recording material S are stacked, and includes a sheet feeding roller 20 and the like.

Figure 2:
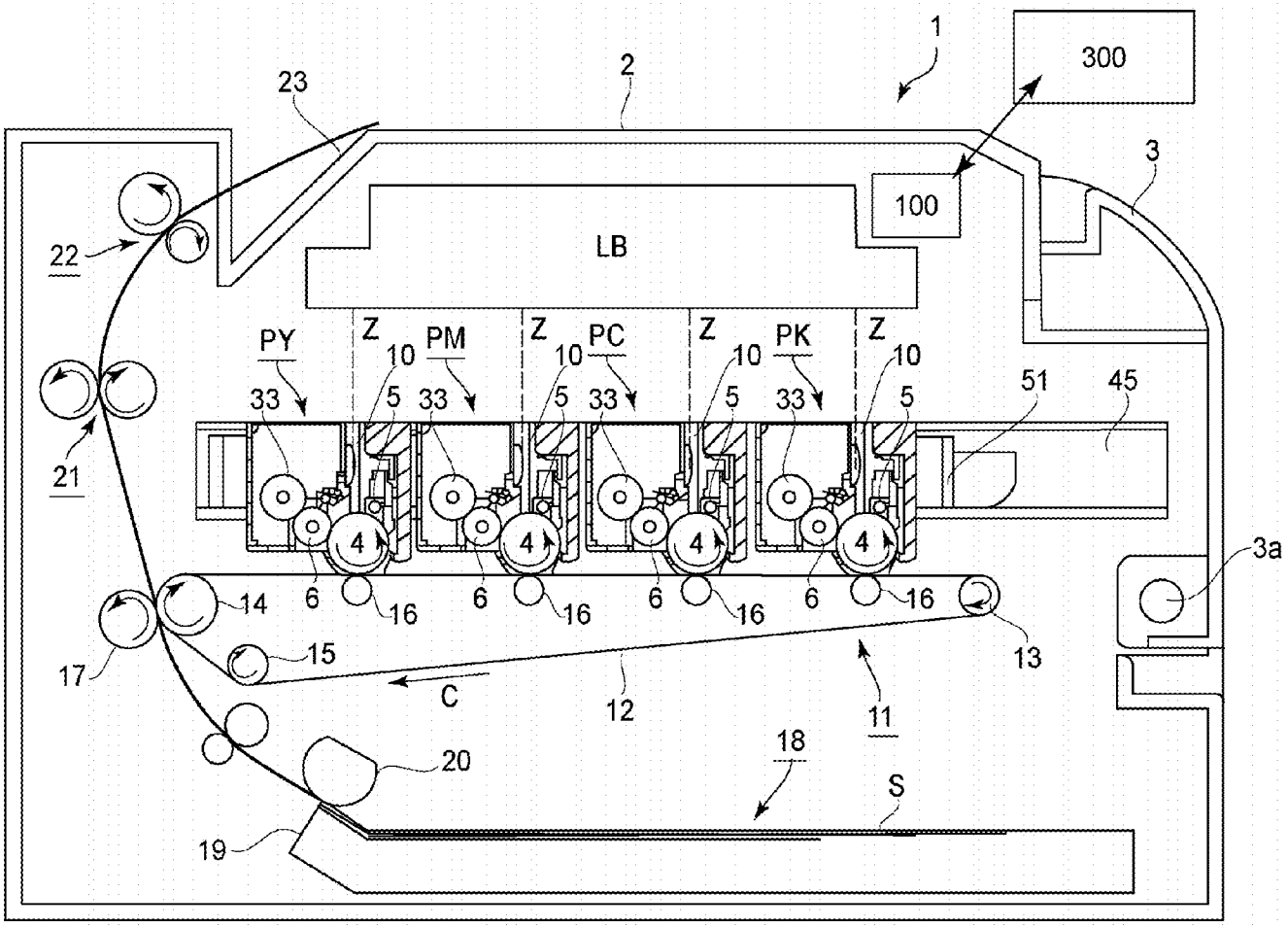
FIG. 2 is a schematic sectional view of an image forming apparatus in which the cartridge is mounted in First Embodiment.

In an upper left side (upper rear side) of the apparatus main assembly 2 in FIG. 2, a fixing unit 21 and a sheet discharging unit 22 are provided. At an upper surface of the apparatus main assembly 2, a sheet discharge tray 23 is defined. On the recording material S, the (unfixed) toner image is fixed as a fixed image by the fixing means provided in the fixing unit 21, and then the recording material S is discharged as an image-formed product onto the discharge tray 23. A recording material feeding path from the feeding unit 18 to the discharging unit 22 is a feeding means for feeding the recording material.

<Image Forming Operation>

An operation for forming a full-color image is as follows. The photosensitive drums 4 of the cartridges P are rotationally driven at a predetermined speed (in an arrow D direction in FIG. 3 and in a counterclockwise direction in FIG. 2). The transfer belt 12 is also rotationally driven in the same direction (arrow C direction in FIG. 2) as the rotational direction of the photosensitive drums 4 (at their contact portions) at a speed corresponding to the speed of the photosensitive drums 4.

The laser scanner unit LB is also driven. In synchronism with the drive of the laser scanner unit LB, the surface of the photosensitive drum 4 of each cartridge is electrically charged uniformly to a predetermined polarity and a predetermined potential by the charging roller 5. The scanner unit LB scans and exposes the surface of each photosensitive drum 4 with the laser light Z depending on an associated color image signal. As a result, the electrostatic latent image depending on the image signal for the associated color is formed on the surface of each photosensitive drum 4. The thus formed electrostatic latent image is developed into a toner image by the developing roller 6 which is rotationally driven (in an arrow E direction in FIG. 3 or in the clockwise direction in FIG. 2) at a predetermined speed.

By the electrophotographic image forming process operation as described above, on the photosensitive drum 4 of the first cartridge PY, a yellow (Y) toner image corresponding to a yellow (Y) component for the full-color image is formed. Then, the toner image is primary-transferred onto the transfer belt 12. Similarly, on the photosensitive drum 4 of the second cartridge PM, a magenta toner image corresponding to a magenta component for the full-color image is formed. Then, the toner image is primary-transferred superposedly onto the yellow toner image which has already been transferred on the transfer belt 12.

Further, on the photosensitive drum 4 of the third cartridge PC, a cyan toner image corresponding to a cyan component for the full-color image is formed. Then, the toner image is primary-transferred superposedly onto the yellow and magenta toner images which have already been transferred on the transfer belt 12. Similarly, on the photosensitive drum 4 of the fourth cartridge PK, a black toner image corresponding to a black component for the full-color image is formed. Then, the toner image is primary-transferred superposedly onto the yellow, magenta and cyan toner images which have already been transferred on the transfer belt 12.

In this way, unfixed and superposedly transferred toner images of yellow, magenta, cyan and black for the four color-based full-color image are formed on the transfer belt 12.

On the other hand, at predetermined control timing, sheets of the recording material S are separated and fed one by one from the feeding unit 18. The recording material S is introduced into a secondary transfer portion which is a contact portion between the secondary transfer roller 17 and the transfer belt 12 with predetermined control timing. As a result, in a process in which the recording material S is nipped and conveyed at the secondary transfer portion, the four color toner images superposed on the transfer belt 12 are collectively secondary-transferred onto the surface of the recording material S. Then, the recording material S on which the toner images are secondary-transferred is introduced into a fixing unit 21 and then is subjected to fixing, so that the recording material S is discharged as a full-color image-formed product onto the discharge tray 23.

<Structure of Cartridge P>

Figure 4:
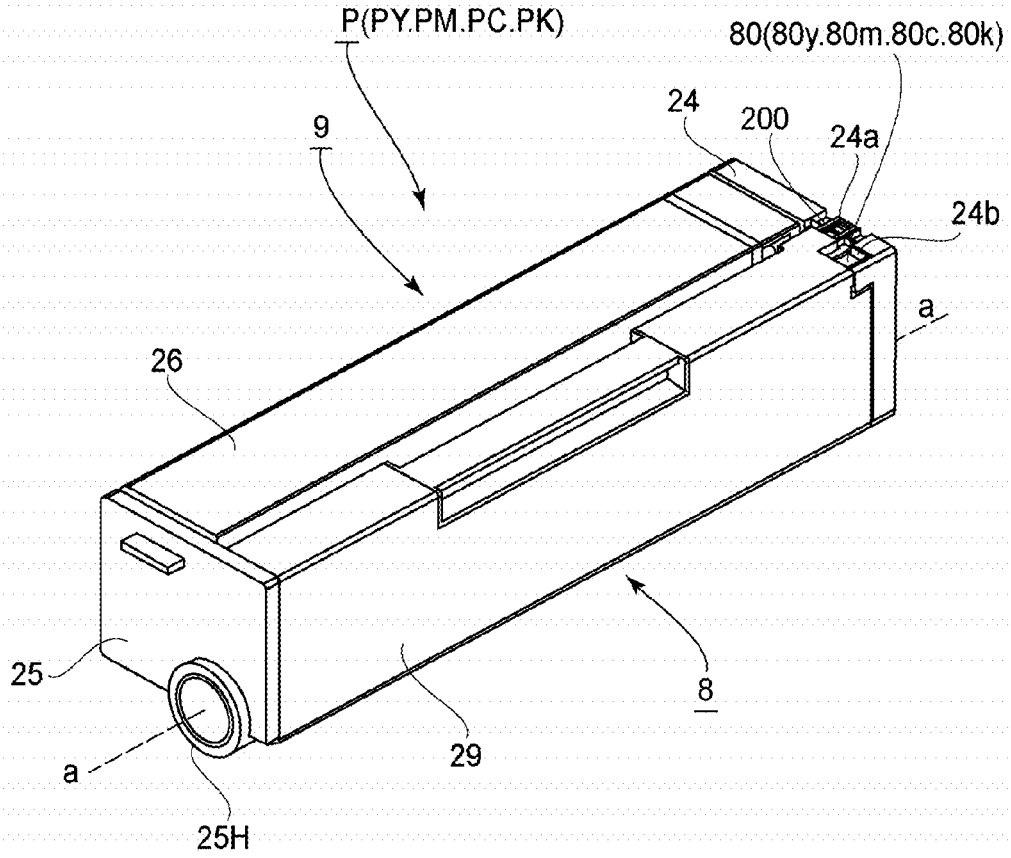
FIG. 4 is a perspective view of an outer appearance of the cartridge as seen from a non-driving-side.
Figure 5:
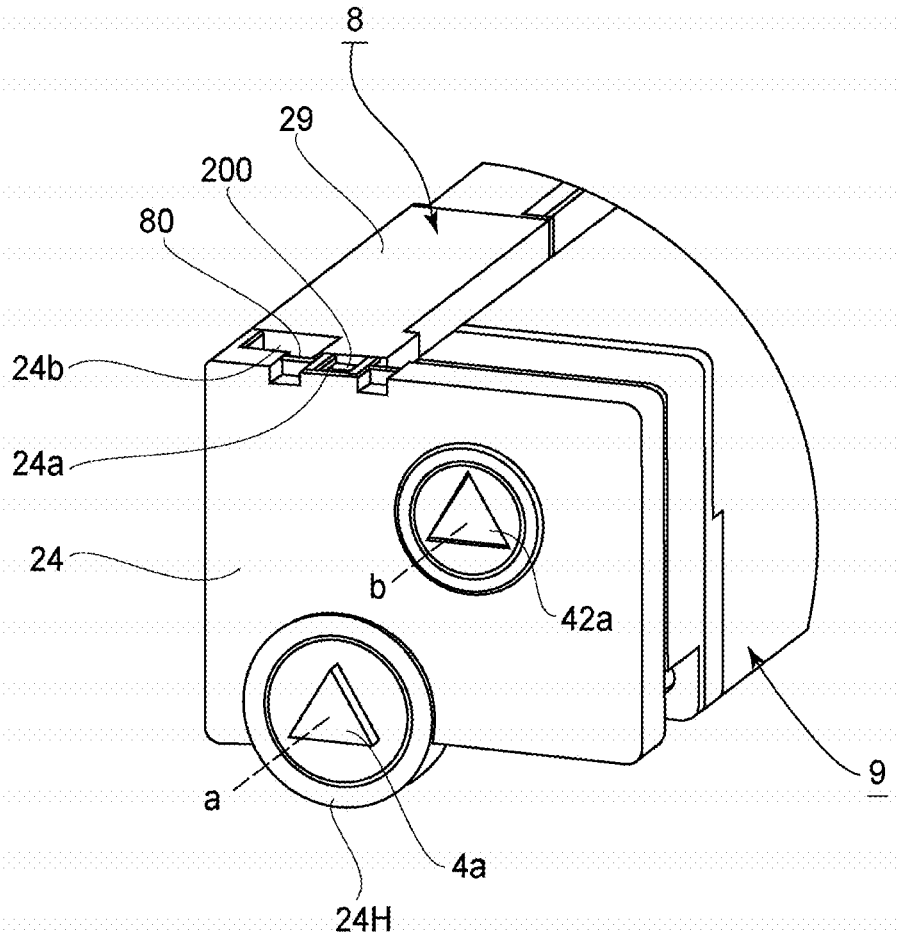
FIG. 5 is a perspective view of a driving-side portion of the cartridge.
Figure 6:
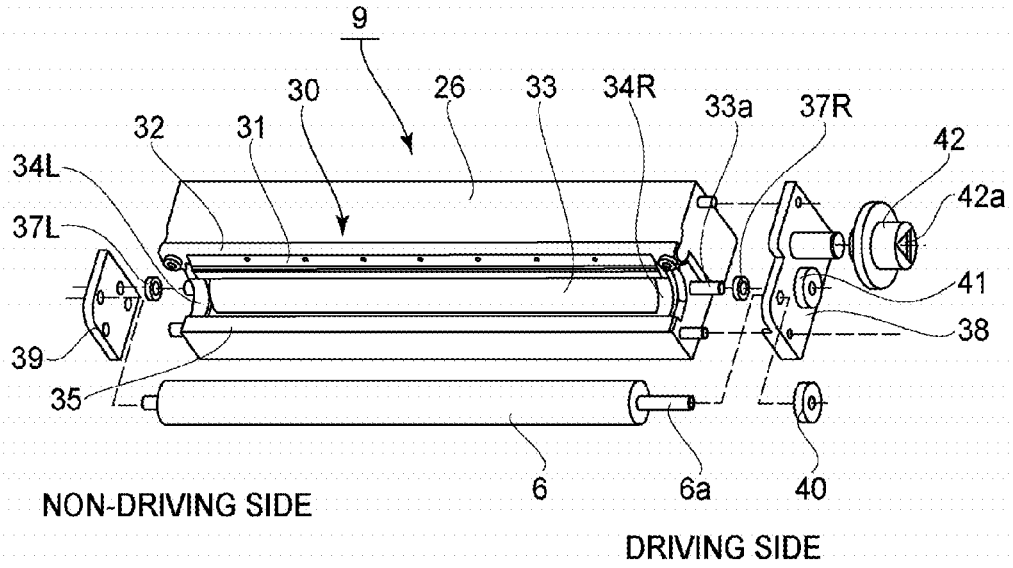
FIG. 6 is an exploded perspective view of a developing device.

A structure of the cartridge P will be described. The respective cartridges P have the same electrophotographic process mechanism and accommodate the toner different in color from each other. FIG. 3 is a schematic sectional view of the cartridge P, and FIG. 4 is a perspective view of the cartridge P as seen from a non-driving-side. FIG. 5 is a perspective view of a driving-side portion of the cartridge P, and FIG. 6 is an exploded perspective view of the developing device 4.

The cartridge P has a substantially rectangular parallelepiped shape extending in a direction of a rotational axis a of the photosensitive drum 4 as a longitudinal direction, and includes the cleaning unit 8, the developing device 9, a driving-side cover member 24 and a non-driving-side cover member 25.

Here, the cartridge is, e.g., a process cartridge or a developing cartridge, and contributes to the image forming process for forming the image on the recording material in a state in which the cartridge is detachably mounted to the apparatus main assembly of the image forming apparatus. The apparatus main assembly of the image forming apparatus means an apparatus constituent portion obtained by excluding the cartridge from constituent members of the image forming apparatus.

The process cartridge is prepared by integrally assembling a rotatable image bearing member, on which a latent image is to be formed, and at least one of a charging means, a developing means, a cleaning means and the like as process means for image formation actable on the image bearing member into a cartridge (unit), and the cartridge is detachably mounted to the apparatus main assembly of the image forming apparatus. Examples of the image bearing member may include an electrophotographic photosensitive member in the electrophotographic image forming type, an electrostatic recording dielectric member in the electrostatic recording image forming type and a magnetic recording (magnetic) material in the magnetic recording image forming type.

Accordingly, the process cartridge includes a cartridge which is prepared by integrally assembling the image bearing member and the developing means as the image forming process means into a unit and which is detachably mounted to the apparatus main assembly. The process cartridge integrally including the image bearing member and the developing means is referred to as a so-called integral type. Further, the process cartridge integrally including the image bearing member and the process means other than the developing means is referred to as a so-called separation type. That is, the process cartridge for forming the image by being paired with a developing unit, as a separate member from the process cartridge, including the developing means is referred to as the separation type.

Further, the developing cartridge includes a developer carrying member (developing roller) for supplying the developer to the image bearing member and accommodates the developer (toner) used for developing the latent image, by the developer carrying member, formed on the image bearing member. The developing cartridge is detachably mounted to the apparatus main assembly.

In the case of the developing cartridge, the image bearing member is mounted to the apparatus main assembly or a cartridge supporting member. Alternatively, the image bearing member is provided in the so-called separation type process cartridge. In this case, the process cartridge does not include the developing means.

Therefore, the cartridge includes the process cartridges of the so-called integral type and the so-called separation type. Further, the cartridge includes the case where the so-called separation type process cartridge and the developing cartridge are used in a pair. Further, the cartridge includes the case where the image bearing member is fixedly mounted to the apparatus main assembly or the cartridge supporting member, and the developing cartridge actable on the image bearing member is used in a detachably mountable manner. Further, the cartridge includes a developer cartridge accommodating the developer (toner) to be supplied to the process cartridge, the developing cartridge or the like.

(Structure of Cleaning Unit 8)

As shown in FIG. 3, the cleaning unit 8 is constituted by the photosensitive drum 4, the charging roller 5, a cleaning container 29, as a first cartridge constituent member including the cleaning blade 7. The photosensitive drum 4 is rotatably supported by a bearing member 24H in the driving-side cover member 24, as a second cartridge constituent member, side and a bearing member 25H in the non-driving-side cover member 25 side. Further, the photosensitive drum 4 obtains a driving force of a motor (not shown) of the apparatus main assembly 2 by engagement of a drum driving coupling 4*a* (FIG. 5) in the driving-side cover member 24 side with a drive output coupling (not shown) in the apparatus main assembly 2 side, and thus is rotationally driven (in the arrow D direction in FIG. 3).

The cleaning container 29 functions as a frame for holding the cleaning blade 7 and the charging roller 5 as the process means for image formation. The charging roller 5 is rotatably supported at its end portions by charging roller bearings 27 in the driving-side and the non-driving-side of the cleaning container 29 and is driven by rotation of the photosensitive drum 4 in contact with the surface of the photosensitive drum 4. At this time, in order to uniformly charge the surface of the photosensitive drum 4, the charging roller 5 is urged against the photosensitive drum 4 by an urging spring 28 at each of the end portions thereof.

The cleaning blade 7 is fixed on the cleaning container 29, and an elastic rubber end portion thereof is disposed in contact with the photosensitive drum 4 in a direction counterdirectionally to the rotational direction (the arrow D direction in FIG. 3). During image formation, the cleaning blade 7 scrapes off a transfer residual toner remaining on the photosensitive drum 4 to clean the surface of the photosensitive drum 4. At this time, the end of the cleaning blade 7 is contacted to the surface of the photosensitive drum 4 at predetermined pressure in order to sufficiently scrape off the transfer residual toner.

Further, the transfer residual toner scraped off from the surface of the photosensitive drum 4 by the cleaning blade 7 is accommodated as a waste (residual) toner in a residual toner accommodating portion 29*a* of the cleaning container 29. For that purpose, on the cleaning container 29, a residual toner collecting sheet member 44 for preventing the residual toner from leaking out from a gap between itself and the photosensitive drum 4 or the cleaning blade 7 is fixed with respect to the longitudinal direction of the photosensitive drum 4. Further, at each of longitudinal end portions of the cleaning blade 7, a cleaning blade end portion seal member (not shown) is provided.

(Structure of Developing Device 9)

A structure of the developing device 9 will be described with reference to FIGS. 3 and 6. The developing device 9 has an elongated shape in which the developing roller (developer carrying member) 6 as the developing means extends in a rotational axis direction as the longitudinal direction. In addition to the developing roller 6, the developing device 9 is constituted by the developing frame 26, a developing blade 31, developing device end portion seal members 34R and 34L, a flexible sheet member 35, and supplying roller shaft seals 37R and 37L.

The developing roller 6 and the developer supplying roller 33 are provided at an opening, and end portions of shafts of the developing roller 6 and the developer supplying roller 33 are rotatably supported by a driving-side bearing 38 and a non-driving-side bearing 39 which are mounted on side surfaces of the developing frame 26. Further, at driving-side end portions of a core material (metal) 6*a* of the developing roller 6 and a core material (metal) 33*a* of the developer supplying roller 33, a driving gear 40 and a supplying roller gear 41 are provided, respectively, and are engaged with a developing device drive input gear 42. The developing device drive input gear 42 includes a developing device drive coupling 42*a* (FIGS. 5 and 6) with which a drive output coupling (not shown) in the apparatus main assembly 2 side is engaged, so that a driving force of a driving motor (not shown) for the apparatus main assembly 2 is transmitted. As a result, the developing roller 6 and the developer supplying roller 33 are rotationally driven at predetermined speeds (arrow E and F directions in FIG. 3).

The developing blade 31 is an about 0.1 mm-thick elastic metal plate, and is an elongated member with respect to the rotational axis direction of the developing roller 6. A developing blade 31 is supported by a supporting metal plate 32, and the supporting metal plate 32 is mounted to the developing frame 26. The developing blade 31 and the supporting metal plate 32 constitute a developing blade unit 30. A free end of the developing blade 31 with respect to a widthwise direction is contacted to the developing roller 6 counterdirectionally to the rotational direction (arrow E direction in FIG. 3). A developing blade seal 36 is provided on the supporting metal plate 32.

As shown in FIG. 6, the developing device end portion seal members 34R and 34L are provided at ends of the opening of the developing frame 26, so that toner leakage from a gap between the developing frame 26 and each of the developing blade 31 and the developing roller 6 is prevented.

Further, the flexible sheet member 35 is provided in contact with the developing roller 6 at a longitudinal side surface in a side where the sheet member 35 opposes the developing blade 31 at the opening of the developing frame 26, thus preventing the toner leakage from a gap between the developing frame 26 and the developing roller 6. Further, the supplying roller shaft seal members 37R and 37L are mounted on the core material 33*a* of the developer supplying roller 33 at exposed portions outside the developing frame 26, thus preventing the toner leakage from a gap between the core material 33*a* and a core material through hole provided in the developing frame 26.

The developing device 9 is a swingably supported by the shaft W1 between the driving-side cover member 24 and the non-driving-side cover member 25. That is, the cleaning unit 8 and the developing device 9 are connected with each other by the shaft W1. Further, the developing device 9 is urged rotatably about the shaft W1 by an urging member (not shown) so that the developing roller 6 openings the photosensitive drum 4 in the cleaning unit 8 side at a predetermined urging force in a free state. A developing drive coupling 42 is provided coaxially with an axis b of the shaft W1.

(Cleaning Unit 8 and Developing Device 9)

In each cartridge P, the cleaning unit 8 is positionally fixed at a positioning portion (described later with reference to FIG. 12) in the apparatus main assembly side in a state in which the cleaning unit 8 is mounted at a mounting portion of the apparatus main assembly 2 in a predetermined manner. The developing device 9 is in the free state during the image formation of the image forming apparatus. That is, the developing device 9 is urged rotatably about the shaft W1 by the urging member so that the developing roller 6 contacts the photosensitive drum 4 in the cleaning unit 8 side at the predetermined urging force.

Further, during the image formation, by the drive, the developer supplying roller 33 and the developing roller 6 are rotated and rubbed with each other, so that the toner in the developer accommodating chamber 26*c* is carried on the developing roller 6. The developing blade 31 regulates a thickness of a toner layer formed on a peripheral surface of the developing roller 6, and at the same time, imparts triboelectric charges, generated between itself and the developing roller 6 by contact pressure, to the toner. Then, at the contact portion between the developing roller 6 and the photosensitive drum 4, the charged toner on the developing roller 6 is deposited on the electrostatic latent image, so that the electrostatic latent image is developed.

Further, during non-image formation of the image forming apparatus, the developing device 8 is held at a position where the developing device 8 is rotated about the shaft W1 against the urging member by an actable member (not shown) in the apparatus main assembly side in a direction in which the developing roller 6 is spaced from the photosensitive drum 4.

(Memory and Color Display Member)

Each cartridge P is provided with a memory 200 for storing pieces of information such as a lot number of the cartridge P, characteristics of the image forming apparatus and characteristics of the process means. Further, the cartridge P is provided with a color display member 80 (80Y, 80M, 80C, 80K) so as to be discriminated depending on the type such as a toner color (FIG. 4).

In each cartridge P, main assembly electrical contacts (contact member) in the apparatus main assembly side are electrically connected with electrical contacts (cartridge electrical contacts) in the memory 200 side in the mounted state at the mounting portion in the apparatus main assembly 2 in the predetermined manner. As a result, it becomes possible to transfer the pieces of image form between the control circuit portion 100 in the apparatus main assembly 2 side and the memory 200 in the cartridge P side. The control circuit portion 100 transfers the pieces of information stored in the memory 200 to grasp a state such as an operation status of the cartridge P, thus effecting control of the image formation depending on the information. As a result, the image formation is carried out under a best condition.

Figure 7:
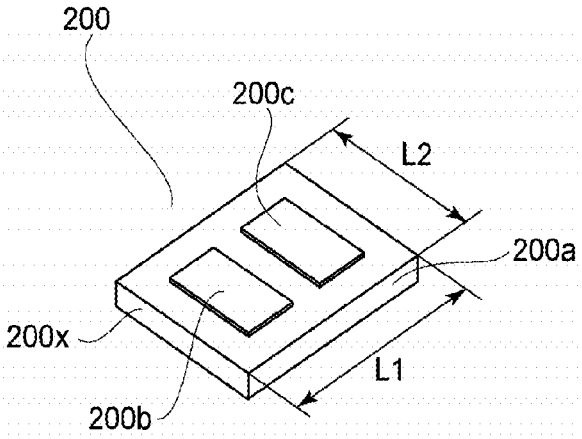
FIG. 7 is a perspective view of an outer appearance of a memory.

FIG. 7 is a perspective view of an outer appearance of the memory 200 in this embodiment. The memory 200 is constituted by a memory substrate 200*a*, a pair of cartridge electrical contacts 200*b* and 200*c*, and an IC (not shown)

which is a memory portion. In this embodiment, the memory portion is described using an example in which the memory portion is contained in a substrate, but may also be in the form in which the memory portion is exposed to an outside of the substrate. In that case, a protective layer may also be formed so as to cover the memory portion with a resin material or the like in order to protect the memory portion. Further, a constitution in which the memory portion is provided in a space formed between a surface 24*a*4 and a projected portion 24*a*5 in FIG. 14 as described later.

The memory 200 includes the cartridge electrical contacts 200*b* and 200*c*, electrically connectable with the main assembly electrical contacts 90 (FIG. 10) of the apparatus main assembly 2, for transmitting the information on the process means of the cartridge P to the control circuit portion 100 of the apparatus main assembly 2. The plurality of electrical contacts 200*b*, 200*c* are provided and arranged along a longitudinal direction of the cartridge.

A memory substrate 200*a* is a rectangular plate member of L1 in length with respect to the longitudinal direction and L2 in length with respect to a widthwise direction, and a pair of the electrical contacts 200*b*, 200*c* is provided and arranged along a longitudinal direction (length L1 direction) of the memory 200. Then, as described later, the memory 200 is inserted so that an arrangement direction of the plurality of electrical contacts coincides with the longitudinal direction of the cartridge.

In this embodiment, the memory 200 is secured to a memory supporting portion (slit portion) 24*a* described later and provided on the driving-side cover member 24 which is a side wall member.

The cartridge electrical contacts 200*b* and 200*c* are electrically connected with the main assembly electrical contacts 90 in the apparatus main assembly 2 side when the cartridge P is mounted in the apparatus main assembly 2. Further, the insert stored in the memory 200 is transmitted via the main assembly electrical contacts 90 to the control circuit portion 100 in the apparatus main assembly 2 side. The memory 200 is mounted in the memory supporting portion 24*a* so that the cartridge electrical contacts 200*b* and 200*c* are directed to the outside.

The color display member 80 of the cartridge P is a member capable of permitting discrimination of the type such as the color of the toner accommodated in the cartridge P. The color display member 80Y of the first cartridge PY indicates that the color of the accommodated toner is yellow (Y). Similarly, the color display members 80M, 80C and 80K of the second, third and fourth cartridges PM, PC and PK, respectively, indicate that the colors of the accommodated toners are magenta (M), cyan (C) and black (K), respectively.

Incidentally, in this embodiment, the color display member 80 is mounted in a color display member supporting portion (slit portion) 24*b*, described later, provided on the driving-side cover member 24 as a color display member supporting means.

(Mounting and Dismounting Constitution (Mounting Means) of Cartridge P Relative to Apparatus Main Assembly 2)

A mounting and dismounting operation of the respective cartridges P (PY, PM, PC, PK) relative to the apparatus main assembly 2 will be described. In the apparatus main assembly 2 in this embodiment, exchange (replacement) of each cartridge is of a type in which a user places the cartridge P (PY, PM, PC, PK) on a pulling-out unit (cartridge tray) 51 and exchanges the cartridge P in a front-access manner.

The pulling-out unit 51 supports the cartridges P mountably and dismountably. The pulling-out unit 51 is constituted so as to be movable (pushable in and pullable out) by a rail member 45 along a rectilinear line between a pulled-out position where the cartridge P can be mounted and dismounted at the outside of the apparatus main assembly 2 and a mounting position where the cartridge P is mounted at the inside of the apparatus main assembly 2.

Figure 8:
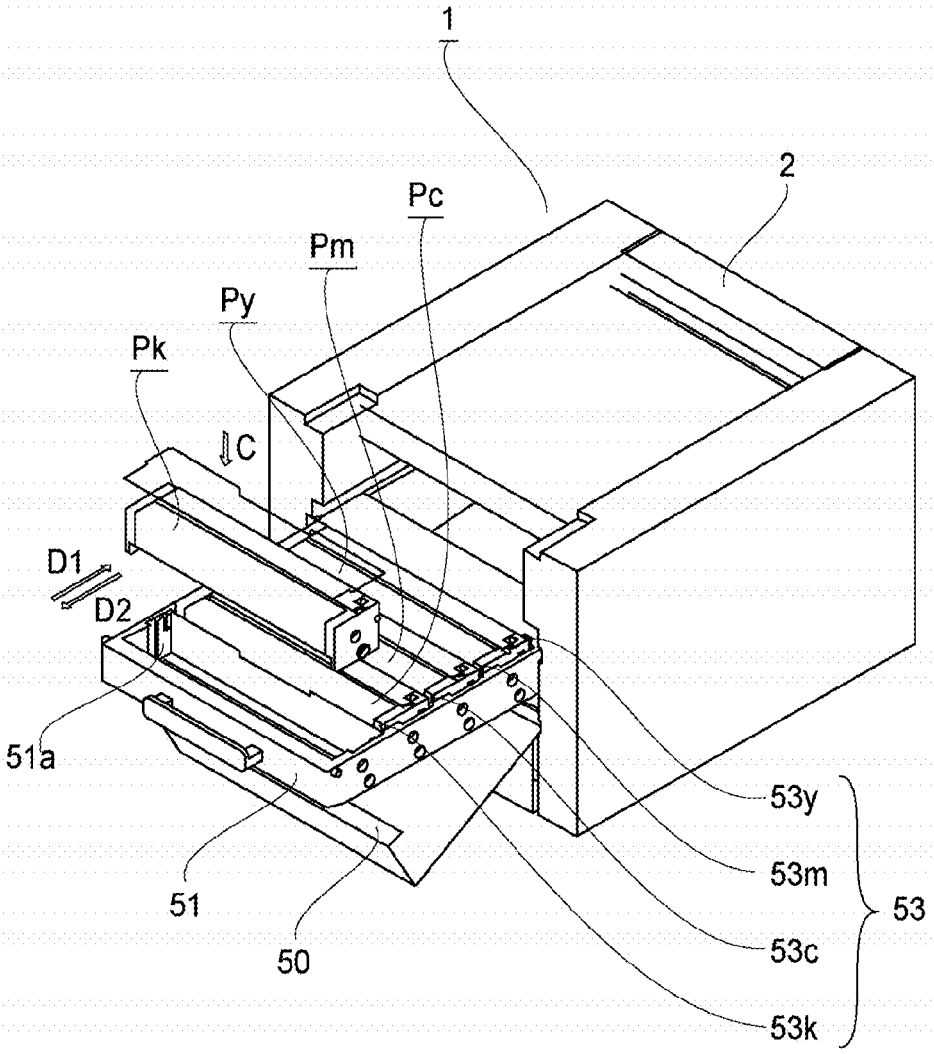
FIG. 8 is an illustration of a mounting and dismounting constitution of the cartridge relative to an apparatus main assembly.

FIG. 2 shows a state in which the pulling-out unit 51 is moved to the mounting position where the cartridge P is mounted at the inside of the apparatus main assembly 2, and in which an apparatus openable door 3 is closed. FIG. 8 shows a state in which the apparatus openable door 3 is opened and then the pulling-out unit 51 is pulled out to the pulled-out position where each of the cartridges P can be mounted and dismounted at the outside of the apparatus main assembly 2. An arrow D2 direction shown in FIG. 8 is a pulling-out movement direction, and an arrow D1 direction is a pushing-in movement direction. The pulling-out movement direction D2 and the pushing-in movement direction D1 are the substantially horizontal direction.

In such a constitution, a mounting operation of the cartridge P in the apparatus main assembly 2 will be described. The user opens the apparatus openable door 3 by rotating the door 3 about a hinge shaft 3*a*. Then, the user moves and pulls out the pulling-out unit 51 to the pulled-out position where the cartridge P can be mounted and dismounted at the outside of the apparatus main assembly 2.

Here, in interrelation with an opening operation of the openable door 3, connection of the drive output portions in the apparatus main assembly side with the drum drive coupling 4*a* and the developing (device) drive coupling 42*a* of the cartridge P is eliminated. In each cartridge P, pressing of the cleaning unit 8 toward the main assembly-side positioning portion 91 (FIG. 12) is eliminated. Further, the connection of the bias output portion in the apparatus main assembly side with the cartridge P is eliminated. Further, the connection of the main assembly electrical contacts 90 (FIG. 10) with the electrical contacts 200*b* and 200*c* of the memory 200 of the cartridge P is eliminated.

Further, by movement of the rail member 45 or the intermediary transfer belt unit 11, spacing between the transfer belt 12 and the photosensitive drum 4 of the cartridge B is made. In this state, the pulling-out unit 51 can be moved from the mounting position in the apparatus main assembly 2 to the pulled-out position.

In a state in which the pulling-out unit 51 is moved to the pulled-out position, the cartridge P can be mounted and dismounted for exchange relative to the cartridge P. That is, the cartridge P is dismounted from the pulling-out unit 51 toward above in an arrow C2 direction, and is mounted and held in the pulling-out unit 51 in an arrow C1 direction (in the substantially gravitation direction).

The respective cartridges P are disposed and arranged in a movement direction so that a longitudinal direction (an axial direction of the photosensitive drum 4) of each cartridge P is a direction perpendicular to the movement direction of the pulling-out unit 51. Further, in the pulling-out unit 51, four cartridge mounting portions 51*a* for permitting mounting of the four cartridges P (PY, PM, PC, PK) are provided in a line. Further, at end portions of the four cartridge mounting portions 51*a*, main assembly display labels 53 (53Y, 53M, 53C, 53K) different depending on the colors of the toners accommodated in the cartridges P are provided.

Figure 9:
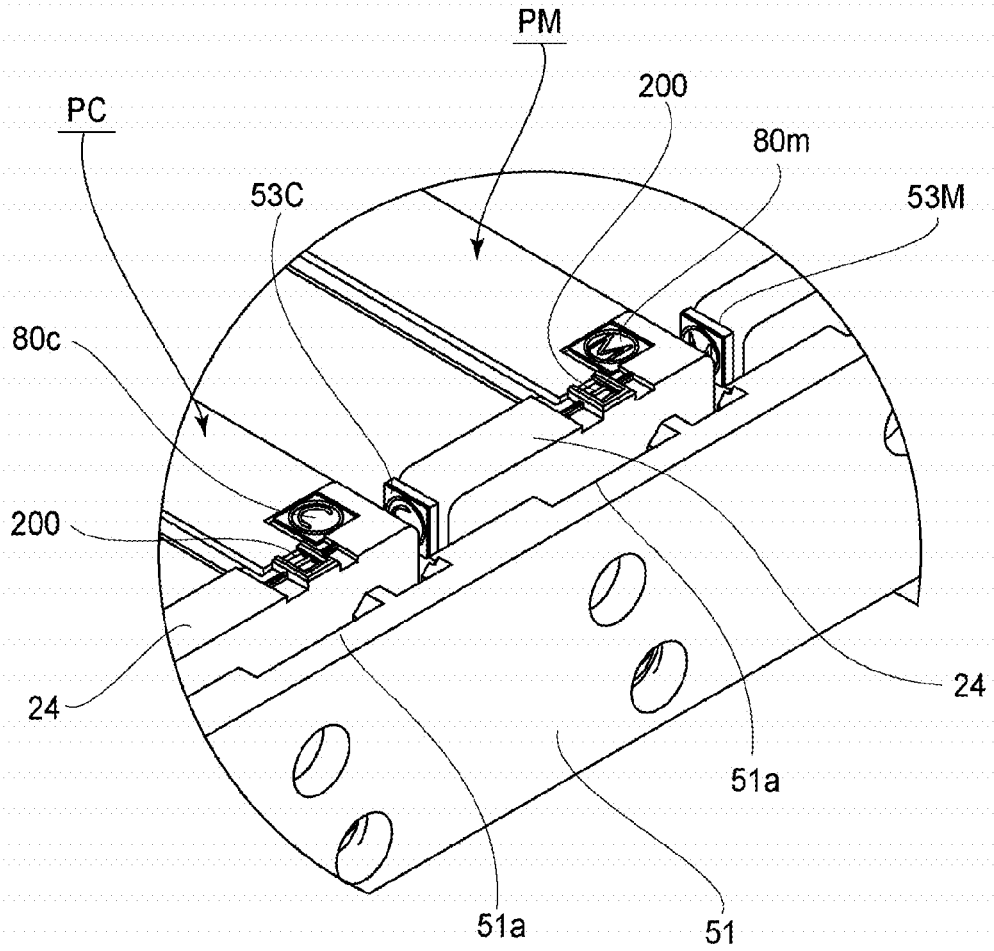
FIG. 9 is a detailed illustration of a color display member when the cartridge is mounted in the apparatus main assembly.

The main assembly display labels 53 are provided correspondingly to the color display members 80 provided on the first to fourth cartridges. Specifically, as shown in FIGS. 8 and 9, on each cartridge P for accommodating the toner of an associated color and on the cartridge mounting portion 51*a* where the cartridge P is to be mounted, the color display member 80 and the main assembly color display label 53 on which the associated color of the toner is displayed are provided, respectively.

Incidentally, in this embodiment, the color display member 80 of the cartridge P is provided on the driving-side cover member 24. The corresponding main assembly color display label 53 is disposed at a driving-side end portion of the cartridge mounting portion 51*a* so that the main assembly color display label 53 can be recognized simultaneously with the color display member 80 when the cartridge P is mounted in the pulling-out unit 51.

As a result, the user visually recognizes the color display member 80 and the main assembly color display label 53 provided at the driving-side end portion of the cartridge mounting portion 51*a* when the cartridge P is newly mounted in the apparatus main assembly 2 or when the cartridge P is exchanged due to the end of a lifetime thereof. Then, by checking that the colors of the color display member 80 and the main assembly color display label 53 coincide with each other, the cartridge P is properly mounted in the cartridge mounting portion 51*a*.

On the other hand, in the case where the colors of the color display member 80 and the main assembly color display label 53 do not coincide with each other, the user can visually recognize that the cartridge P is erroneously inserted, and therefore it is possible to prevent an erroneous insertion of the cartridge P into the cartridge mounting portion 51*a*. Incidentally, even if the cartridge P is forcedly inserted, the cartridge P and the apparatus main assembly 2 are not damaged since the cartridge P or the cartridge mounting portion 51*a* is provided with a projection or a cut-away portion for discrimination.

With respect to the necessary cartridge P corresponding to a predetermined mounting portion 51*a* of the pulling-out unit 51, an old cartridge is replaced with a new cartridge, and then the pulling-out unit 51 is sufficiently moved and pulled into the apparatus main assembly 2. Then, the apparatus operable door 3 is closed.

Here, in interrelation with a closing operation of the door 3, by movement of the rail member 45 or the intermediary transfer belt unit 11, contact between the transfer belt 12 and the photosensitive drum 4 of each cartridge P is made. In each cartridge P, pressing of the cleaning unit 8 toward the main assembly-side positioning portion 91 (FIG. 12) is made. The connection of the main assembly-side drive output portions with the drum drive coupling 4*a* and the developing drive coupling 42*a* of each cartridge P is made.

Further, the connection of the main assembly-side bias output portion with each cartridge P is made. Further, the connection of the main assembly electrical contacts 90 (FIG. 10) with the electrical contacts 200*b* and 200*c* of the memory 200 of each cartridge P is made.

As a result, the image forming apparatus 1 is placed in a state in which the cartridges P are mounted at predetermined mounting portions in the apparatus main assembly 2, so that the image forming apparatus 1 is capable of performing an image forming operation.

Figure 10:
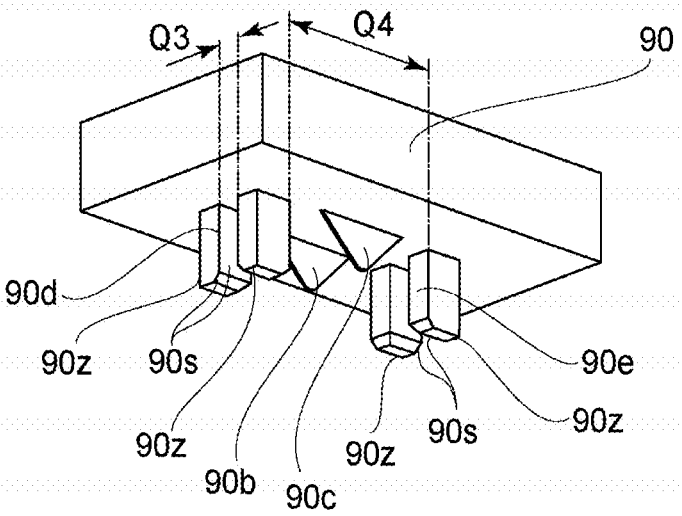
FIG. 10 is a perspective view of main assembly electrical contacts.

The electrical contacts 200*b* and 200*c* are, as is understood from FIG. 10, longer in length with respect to an arrow D2 (pulling-out movement direction) or an arrow D1 (pushing-in movement direction) in FIG. 8 than in length with respect to a direction perpendicular to the arrow D1 direction or the arrow D2 direction. That is, a margin with respect to the movement direction can be made larger than that with respect to the direction perpendicular to the movement direction.

(Positioning Constitution of Cartridge P)

A positioning constitution when the cartridges P are mounted in the apparatus main assembly 2 will be described specifically with reference to FIGS. 10-12 and 16. Incidentally, in the following, an arrow X direction is the longitudinal direction of the cartridge P and is a direction parallel to an inserting direction of the memory 200 shown in FIG. 1. An arrow Y direction is defined as a direction perpendicular to the inserting direction (X direction) of the memory 200 in a plane crossing a thickness direction of the memory 200, and an arrow Z direction is defined as the thickness direction of the memory 200.

FIG. 10 is a perspective view of the main assembly electrical contact 90. The main assembly electrical contact 90 is provided with contact positioning portions 90*d* and 90*e* formed in slits for permitting engagement with positioning ribs 24*d* and 24*e* (FIG. 11), respectively, of the driving-side cover member 24 of the cartridge P. Incidentally, at an end of each of the contact positioning portions 90*d* and 90*e*, a guiding surface 90*s* for guiding the engagement with the rib 24*d* or 24*e* of the driving-side cover member 24. Further, the main assembly electrical contact 90 is provided with electrical contact portions 90*b* and 90*c* contactable with the electrical contacts 200*b* and 200*c* (FIG. 7), respectively, of the memory 200.

Figure 11:
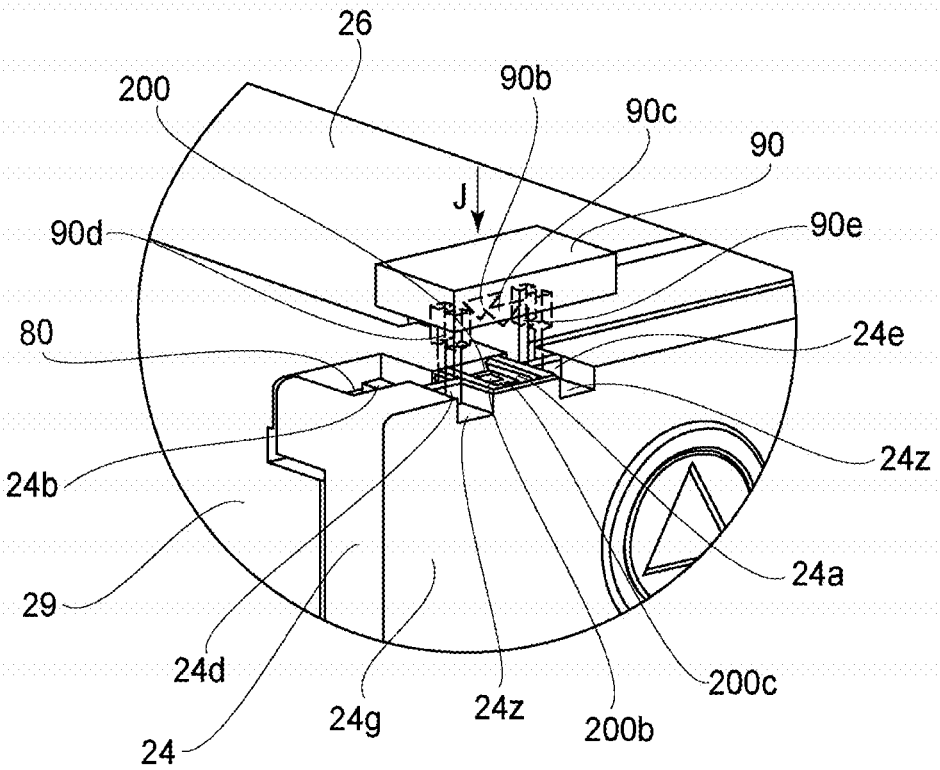
FIGS. 11 and 12 are illustrations each showing a state in which a pulling-out unit is moved to a mounting position in the apparatus main assembly and in which an apparatus openable door is open.

FIG. 11 shows a state in which the pulling-out unit 51 is moved to the mounting position in the apparatus main assembly 2 and in which the apparatus openable door 3 is opened. In this state, the contact positioning portions 90*d* and 90*e* are not engaged with the positioning ribs 24*d* and 24*e* of the driving-side cover member 24 of the cartridge P. Accordingly, the electrical contact portions 90*b* and 90*c* of the main assembly electrical contact 90 do not contact the electrical contacts 200*b* and 200*c* of the memory 200. In other words, the memory 200 and the main assembly electrical contact 90 are in a state in which they are not electrically connected with each other.

Figure 12:
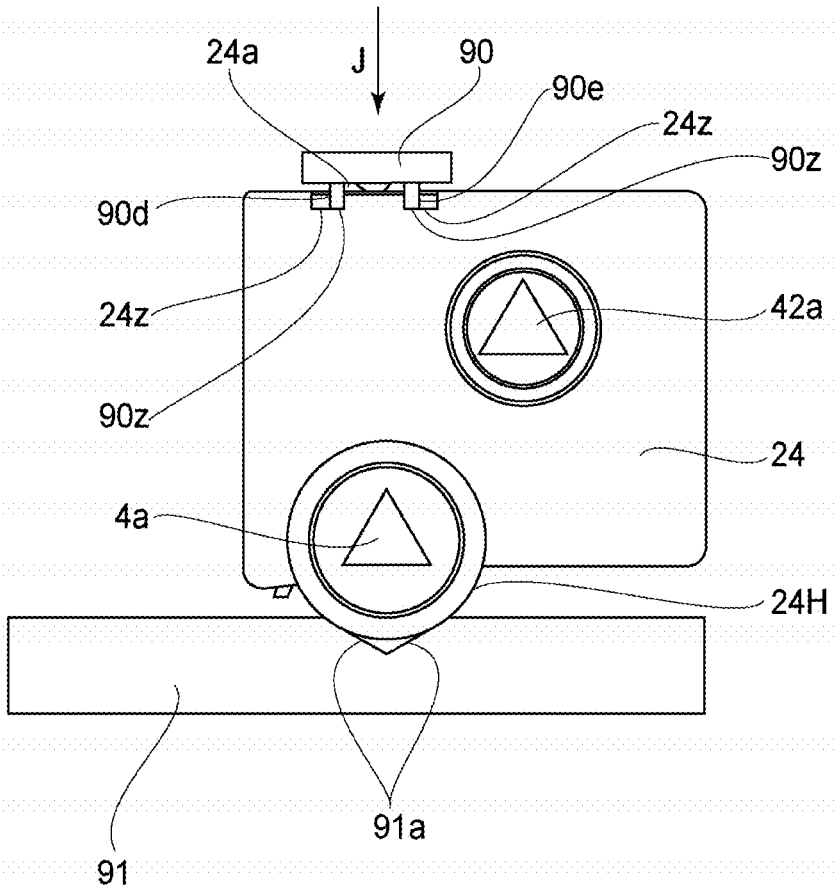

FIG. 12 shows a state in which the pulling-out unit 51 is moved to the mounting position in the apparatus main assembly 2 and in which the door 3 is closed. In this state, the contact positioning portions 90*d* and 90*e* of the main assembly electrical contact 90 engage with the positioning ribs 24*d* and 24*e* of the driving-side cover member 24 of the cartridge P.

Specifically, in interrelation with the closing operation of the door 3 of the apparatus main assembly 2, the main assembly electrical contact 90 is lowered in an arrow J direction in FIG. 11, so that at first the guiding surfaces 90*s* provided at the ends of the contact positioning portions 90*d* and 90*e* contact the positioning ribs 24*d* and 24*e*. Thereafter, when the main assembly electrical contact 90 is further lowered, the contact positioning portions 90*d* and 90*e* guided by the guiding surfaces 90*s* engage with the positioning ribs 24*d* and 24*e*.

In this case, a width Q1 (FIG. 16) of each of the positioning ribs 24*d* and 24*e* and a width Q3 (FIG. 10) of each of the contact positioning portions 90*d* and 90*e* are mutually engageable dimensions. For that reason, positioning of the main assembly electrical contact 90 relative to the memory 200 with respect to the arrow X direction (FIG. 1) is made. Further, a width Q2 (FIG. 16) between the positioning ribs 24*d* and 24*e* and a width Q4 (FIG. 10) between the contact positioning portions 90*d* and 90*e* are mutually engageable dimensions, and therefore positioning of the main assembly electrical contact 90 relative to the memory with respect to the arrow Y direction (FIG. 1) is made.

Further, by abutment of end surfaces 90*z* of the contact positioning portions 90*d* and 90*e* against recessed surfaces 24*z* (portions-to-be-urged: FIG. 11) of the driving-side cover member 24, positioning of the main assembly electrical contact 90 relative to the memory 200 with respect to the arrow Z direction (FIG. 1) is made.

As described above, the main assembly electrical contact 90 is positioned relative to the memory 200, whereby it is possible to bring the electrical contact portions 90*b* and 90*c* into contact with the electrical contacts 200*b* and 200*c* of the memory 200 with reliability.

Incidentally, as shown in FIG. 12, in interrelation with the closing operation of the door 3, the pressing of the cleaning unit 8 of each cartridge P toward the main assembly-side positioning portion 91 is made. Specifically, each of portions-to-be-positioned (bearing portions) 24H and 25H provided on the side cover members 24 and 25 is abutted against a V-character portion 91*a* provided in the main assembly-side positioning portion 91, whereby the cartridge P is positioned relative to the apparatus main assembly 2.

At this time, the driving-side side cover member 24 is urged in the arrow J direction of FIG. 12 by an unshown urging member (means) provided above the main assembly electrical contact 90. Similarly, also the non-driving-side side cover member 25 is urged in the arrow J direction of FIG. 12 by an unshown urging member. In this way, a constitution in which the driving-side side cover member 24 receives a force from the unshown urging member provided on the main assembly electrical contact 90 is employed.

Here, the driving-side side cover member 24 includes the portion-to-be-positioned 24H relative to the main assembly positioning portion 91 and the positioning ribs 24*d* and 24*e* relative to the main assembly electrical contact 90. In this embodiment, a constitution in which the driving-side side cover member 24 including the positioning portion relative to the apparatus main assembly supports the memory 200 is employed. For that reason, the memory 200 can be positioned relative to the main assembly electrical contact 90 with high accuracy.

Figure 16:
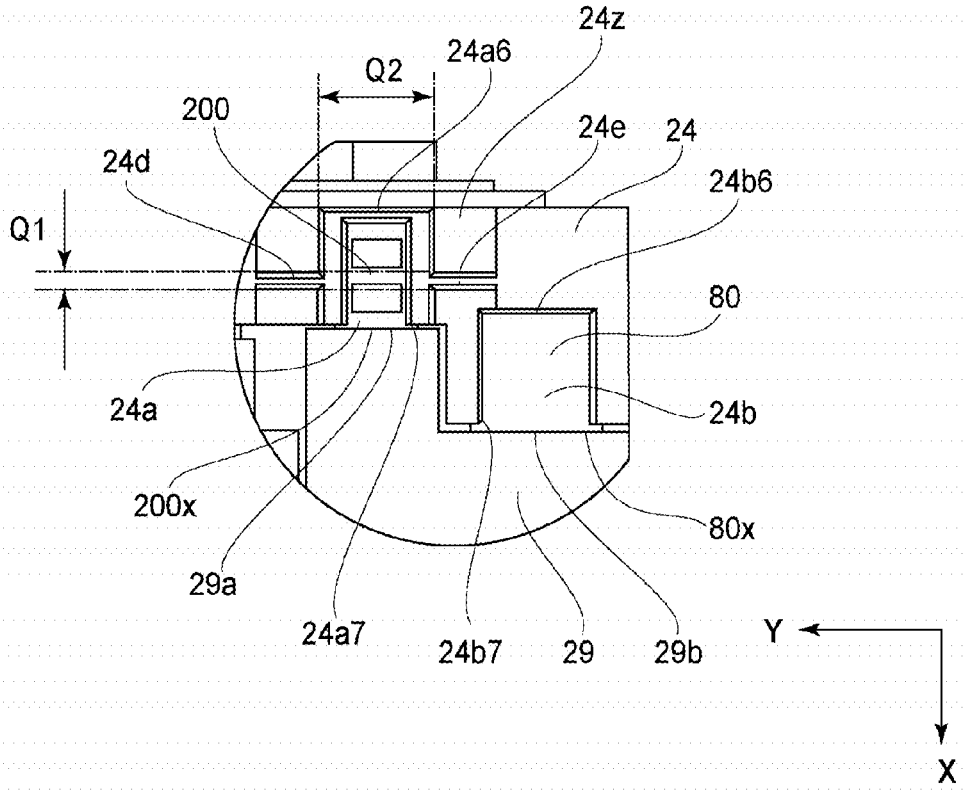
FIG. 16 is an illustration showing a state in which the memory and the color display member are assembled.

Further, as shown in FIGS. 11 and 16, in this embodiment, the memory 200 supported by the driving-side side cover member 24 is disposed outside (end portion side) relative to the color display member 80 with respect to the longitudinal direction (arrow Y direction of FIG. 1) of the cartridge P. That is, the memory 200 is disposed in a side close to a side surface 24*g* having a wall extending in a vertical direction to a force applied from the main assembly urging member in the arrow J direction.

When the memory 200 to which the force is applied from the urging member (not shown) provided above the main assembly electrical contact 90 is provided at the longitudinal outside (end portion side) portion, of the driving-side side cover member 24, where rigidity is stronger, it is possible to suppress deformation of the driving-side side cover member 24 at the time when the cover member 24 receives the force from the main assembly electrical contact 90.

Accordingly, the above arrangement is effective, as the arrangement of the structure in which the cover member 24 supports the memory 200 and the color display member 80, in suppressing a degree of deformation of the cover member 24 and in positioning of the cartridge P relative to the apparatus main assembly 2 with high accuracy when the cartridge P is positioned relative to the apparatus main assembly 2. Particularly, the above-described arrangement achieves a better effect as a constitution when the memory 200 and the color display member 80 are disposed in a limited space. However, the arrangement of the memory 200 and the color display member 80 is not limited thereto.

(Supporting Structure for Memory 200 and Color Display Member 80)

A supporting structure for the memory 200 and the color display member 80 in each cartridge P will be described specifically with reference to FIGS. 1, 4, 5, 7 and 13-16. Incidentally, the supporting structures for the memory 200 an the color display member 80 in each of the cartridges P are the same.

In this embodiment, as shown in FIGS. 4 and 5, each cartridge P (PY, PM, PC, PK) is provided with the memory 200, for storing information, on an upper surface of the driving-side cover member 24 as a supporting means for supporting the memory 200 and the color display member 80. Similarly, on the upper surface of the driving-side cover member 24, the color display member 80 for displaying color information is provided.

As the color display member 80, a member colored correspondingly to an associated one of the colors (Y, M, C, K) of the cartridges P (PY, PM, PC, PK) is mounted. Here, as described above, the arrow X, Y and Z directions are defined as the direction parallel to the inserting direction of the memory 200, the direction perpendicular to the inserting direction (X direction) of the memory 200, and the thickness direction of the memory 200, respectively.

(Mounting of the Memory and Color Display Member as Cartridge Manufacturing Method)

In the following, a mounting method of the memory 200 and the color display member 80 will be described specifically. FIG. 1 is an exploded perspective view of the memory 200 and the color display member 80, and FIG. 13 is a perspective view of the driving-side (side) cover member 24.

Figure 13:
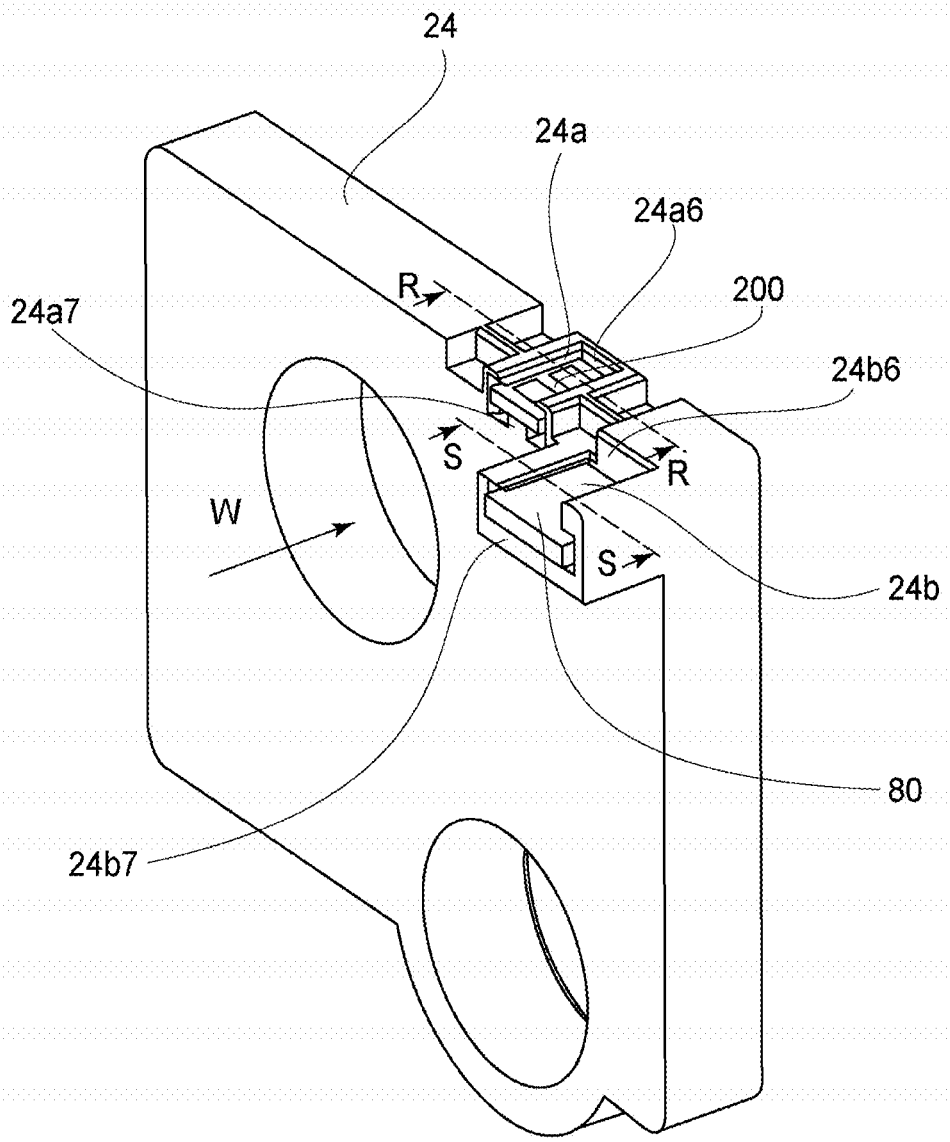
FIG. 13 is a perspective view of a driving-side side cover member.

As shown in FIGS. 1 and 13, the memory 200 and the color display member 80 are mounted on the upper surface of the driving-side cover member 24. The driving-side cover member 24 is provided with a memory supporting portion 24*a* as a first supporting portion for supporting the memory 200. In this embodiment, the memory supporting portion 24*a* is a slit which is open with respect to one direction in order to permit insertion of the memory 200.

Similarly, the driving-side cover member 24 is provided with a color display member supporting portion 24*b* as a second supporting portion for supporting the memory 200. Also, the color display member supporting portion 24*b* is, similarly as the memory supporting portion 24*a*, a slit which is open with respect to one direction in order to permit insertion of the memory 200.

Further, as shown in FIGS. 1 and 13, the memory 200 and the color display member 80 are inserted into the above-described supporting portions 24*a* and 24*b*, respectively. That is, the memory 200 and the color display member 80 are slid, with respect to an arrow W direction, into open portions 24*a*7 and 24*b*7, respectively, provided in the memory supporting portion (slit) 24*a* and the color display member supporting portion (slit) 24*b* for the driving-side cover member 24. That is, the inserting direction of the memory 200 into the supporting portion 24*a* and the inserting direction of the color display member 80 into the supporting portion 24*b* are the same direction.

The supporting portions (insertion portions) 24*a* and 24*b* into which the memory 200 and the color display member 80 are inserted, respectively, may be disposed on the same flat surface (plane) of the driving-side cover member 24 or may also be disposed on flat surfaces (planes), different in height, of the driving-side cover member 24.

Figure 14:
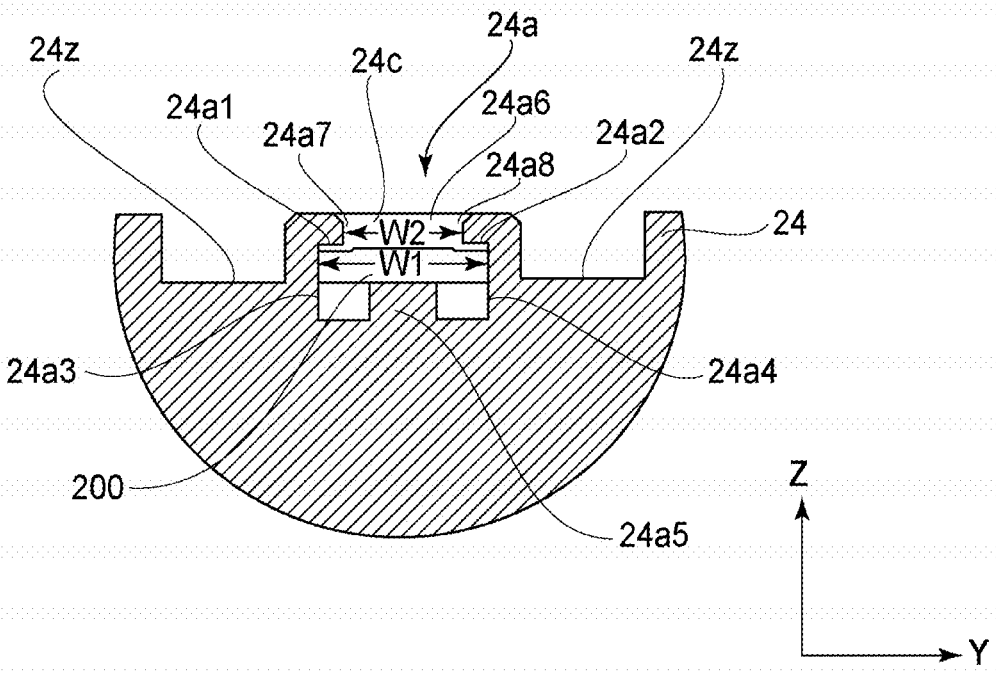
FIG. 14 is an enlarged sectional view along an R-R line in FIG. 13.

FIG. 14 is a sectional view taken along R-R line shown in FIG. 13. The memory 200 is supported by a projected portion 24*a*5 of the memory supporting portion 24*a*, and is prevented from moving the arrow Z direction by projected portions 24*a*1 and 24*a*2 of the memory supporting portion 24*a*. Further, the memory 200 is prevented from moving in the arrow Y direction by surfaces (sides) 24*a*3 and 24*a*4 of the memory supporting portion 24*a*. Further, a free end of the memory 200 with respect to the inserting direction is prevented from moving by a surface (side) 24*a*6 opposite from the open portion 24*a*7 of the memory supporting portion 24*a*. That is, a through hole is not provided, and therefore the memory 200 is inserted from only one direction.

In FIG. 14, when an interval (preventing width) between the surfaces 24*a*3 and 24*a*4 of the memory supporting portion 24*a* is W1 and an interval between the surfaces 24*a*7 and 24*a*8 of the memory supporting portion at a narrow width portion is W2, the intervals W1 and W2 satisfy the following (magnitude) relationship relative to a longitudinal length L1 and a widthwise length L2 of the memory substrate 200*a*.

$$L1>W1>L2>W2$$

As a result, first, by satisfying the relationship of: L1>W1>L2, the memory can only be inserted from a planar region, of the memory with respect to a widthwise (short) direction, narrower than the preventing width W1, so that the memory inserting direction and the memory longitudinal direction coincide with each other. Further, by satisfying the relationship of: W1>L2>W2, demounting of the inserted memory in the memory thickness direction can be suppressed.

Figure 15:
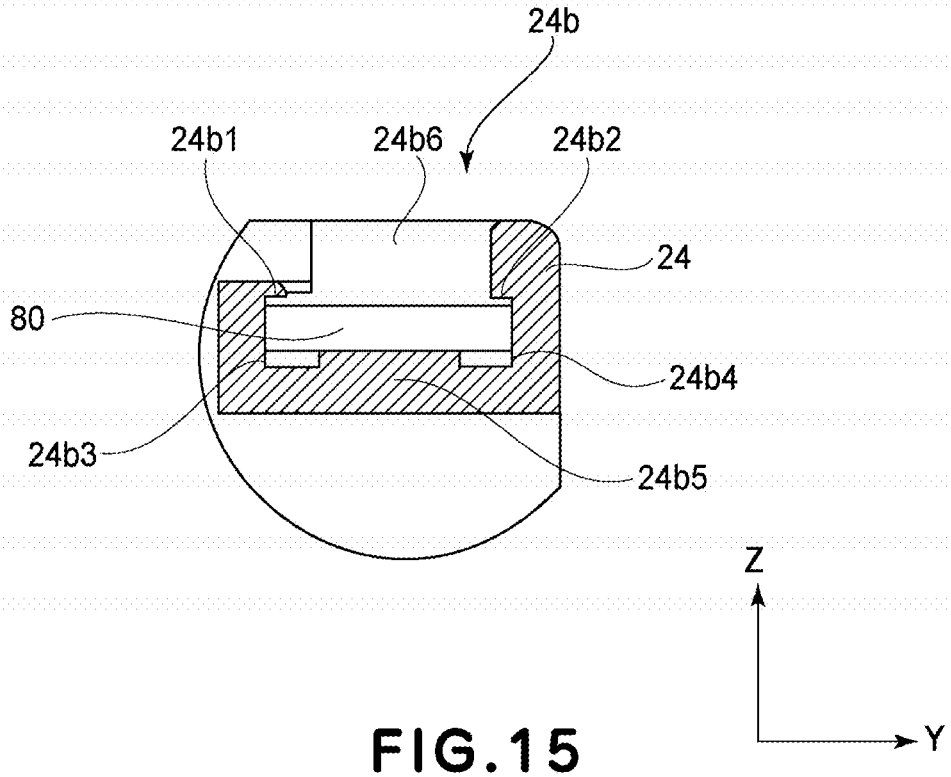
FIG. 15 is an enlarged sectional view along an S-S line in FIG. 13.

FIG. 15 is a sectional view taken along S-S line shown in FIG. 13. The color display member 80 is supported by a projected portion 24*b*5 of the color display member supporting portion 24*b*, and is prevented from moving the arrow Z direction by projected portions 24*b*1 and 24*b*2 of the color display member supporting portion 24*b*. Further, the color display member 80 is prevented from moving in the arrow Y direction by surfaces (sides) 24*b*3 and 24*b*4 of the memory supporting portion 24*b*. Further, a free end of the memory 200 with respect to the inserting direction is prevented from moving by a surface (side) 24*b*6 opposite from the open portion 24*b*7 of the color display member supporting portion 24*b*.

Here, when each of the cartridges P (PY, PM, PC, PK) is mounted in the apparatus main assembly 2, the electrical contact portions 90*b* and 90*c* of the main assembly electrical contact 90 (FIG. 10) contact the electrical contacts 200*b* and 200*c* of the memory 200 through an upward open portion 24*c* of the memory 200. As a result, the control circuit portion 100 in the apparatus main assembly 2 side and the memory 200 in the cartridge P side are capable of establishing communication there between.

FIG. 16 is an illustration showing an assembled state of the memory 200 and the color display member 80. By mounting the driving-side side cover member 24 to the cleaning container 29, the memory 200 and the color display member 80 are prevented from moving in the arrow X direction by (movement) preventing surfaces (sides) 29*a* and 29*b*, respectively, provided on the cleaning container 29.

Specifically, at a driving-side side surface of the cleaning container 29, a mounting surface 29*c* (FIG. 1), the memory (movement) preventing surface 29*a* and the color display member (movement) preventing surface 29*b* of the driving-side side cover member 24 are provided. The driving-side side cover member 24 on which the memory 200 and the color display member 80 are inserted in the memory supporting portion 24*a* and the color display member supporting portion 24*b*, respectively is mounted on the mounting surface 29*c* of the cleaning container 29.

Further, when the driving-side side cover member 24 is assembled with the cleaning container 29, an upstream free end surface 200*x* with respect to the inserting direction of the memory 200 opposes the memory preventing surface 29*a*, and an upstream free end surface 80*x* with respect to the inserting direction of the color display member 80 opposes the color display member preventing surface 29*b*, respectively. As a result, movement of the memory 200 in the arrow X direction is prevented by the memory preventing surface 29*a* and the above-described the surface 24*a*6 opposite from the open portion 24*a*7. Similarly, movement of the color display member 80 in the arrow X direction is prevented by the color display member preventing surface 29*b* and the surface 24*b*6 opposite from the open portion 24*b*7.

That is, when the cleaning container 29 and the driving-side side cover member 24 are assembled with each other, the movement of the memory 200 inserted in the memory supporting portion 24*a* is prevented by the memory preventing surface 29*a*, and the movement of the color display member 80 inserted in the color display member supporting portion 24*b* is prevented by the color display member preventing surface 29*b*.

The memory 200 in this embodiment has a rectangular shape having the length L1 with respect to the longitudinal direction of the memory 200 and the length L2 with respect to the widthwise (short) direction of the memory 200 as shown in FIG. 7. The memory 200 is inserted into the memory supporting portion 24*a* provided on the driving-side side cover member 24.

At that time, the memory 20 is constituted so that the memory longitudinal direction (L1 direction in FIG. 7) and the inserting direction (arrow W direction in FIG. 13) of the memory supporting portion (slit) 24*a* into the open portion 24*a*7 are the same direction. That is, an entire region of the length L1 of the memory 200 with respect to the memory longitudinal direction is prevented by the surfaces 24*a*3 and 24*a*4 of the memory supporting portion 24*a* shown in FIG. 15, whereby the movement of the memory 200 in the arrow Y direction is prevented.

In the above constitution, compared with the case where the memory widthwise direction (L2 direction in FIG. 7) and the inserting direction (arrow W direction in FIG. 13) of the memory 200 into the open portion 24*a*7, the movement is prevented in a longer region, and therefore tilt of the memory 200 can be prevented with high accuracy. Accordingly, an outer configuration of the memory 200 relative to the main assembly electrical contact 90 can be made smaller, or the electrical contacts 200*b* and 200*c* can be made smaller, and therefore the memory 200 can be downsized.

(Summary of Cartridge in this Embodiment)

The constitution of the cartridge P in this embodiment is summarized as follows. The cartridge P in this embodiment contributes to the image forming process in the state in which the cartridge P is detachably mounted in the apparatus main assembly 2 of the image forming apparatus for forming the image on the recording material S. The cartridge P includes the cleaning container (first cartridge constituent member) 29 and the driving-side side cover member (second cartridge constituent member) 29 which are to be assembled with each other. The cartridge P includes the memory 200 for storing the information on the cartridge P and the color display member 80 for displaying the color information of the developer accommodated in the cartridge P.

The driving-side side cover member 24 is provided with the memory supporting portion (first supporting portion) 24*a* having the slit opened for permitting the insertion of the memory 200 and the color display member supporting portion (second supporting portion) 24*b* having the slit opened for permitting the insertion of the color display member 80.

The cleaning container 29 is provided with the memory preventing surface (first preventing portion) 29*a* for preventing the movement 200, inserted in the memory supporting portion 24*a*, when the cleaning container 29 and the driving-side side cover member 24 are assembled with each other. Similarly, the cleaning container 29 is provided with the color display member preventing surface (second preventing portion) 29*b* for preventing the movement of the color display member 80 inserted in the color display member supporting portion 24*b*.

The slit of the memory supporting portion 24*a* and the slit of the color display member supporting portion 24*b* are open in the same direction from an upstream side toward a downstream side with respect to the assembling direction of the cleaning container 29 and the driving-side side cover member 24. Then, the memory 200 is inserted so that the memory longitudinal direction (L1 direction in FIG. 7) and the inserting direction (arrow W direction in FIG. 13) in which the memory 200 is inserted into the memory supporting portion (slit) 24*a* through the open portion 24*a*7 are the same direction.

In this way, a constitution in which the memory 200 and the color display member 80 are assembled with the driving-side side cover member 24 as the supporting means from the same direction and then positions of the memory 200 and the color display member 80 are prevented from movement only by mounting the cover member 24 to the cleaning container 29. As a result, it is possible to easily fix the memory 200 and the color display member 80 on the cartridge P with high accuracy.

On the other hand, by demounting the driving-side side cover member 24 from the cleaning container 29, the memory 200 can easily be demounted. That is, in the case where if an inconvenience generates in the memory 200, demounting and exchange of the memory 200 can be made simply without destroying parts thereof. Accordingly, it is possible to provide a cartridge having a good recycling efficiency and a memory exchanging operation efficiency.

The inserting direction of the memory 200 into the supporting portion 24*a* and the inserting direction of the color display member 80 into the supporting portion 24*b* are the same direction, so that it is possible to obtain an effect such that the assembling is facilitated when the cartridge is assembled automatically.

Further, in this embodiment, the supporting portions (insertion portions) 24*a* and 24*b* in which the memory 200 and the color display member 80 are inserted, respectively, are different in height, so that this difference in height provides an effect of contributing to the downsizing of the cartridge. Further, the memory 200 and the color display member 80 are not placed in a single supporting portion (insertion portion) but are placed in different supporting portions (insertion portions), whereby it is possible to obtain an effect such that accumulation of play can be prevented.

Here, in the case where control of the image formation is effected depending on the color of the toner filled in the cartridge P, there is a need to write (store) the color information of the cartridge P in the memory 200 by checking the color of the toner filled in the cartridge P. The memory 200 in this embodiment is disposed in the neighborhood of the color display member 80. For that reason, the checking of the color of the color display member 80 and the writing of the color information in the memory 200 can be performed in the same (single) step. Accordingly, the step of writing the color information in the memory 200 can be further simplified.

The memory 200 and the color display member 80 which have been conventionally fixed by different means (such as thermal caulking and the double-side tape) are only required to be fixed to the cleaning container 29 after being inserted into the driving-side side cover member 24, so that the positions thereof are prevented from movement. For that reason, it is possible to realize not only an improvement in assembling property but also a reduction in cost.

Further, as the color display member 80 in this embodiment, a resin plate having rigidity is used. An advantage of this is such that compared with a flexible sheet material such as a label which has been conventionally used, the rigid resin plate is more suitable for automation of assembling such as supply or handling of components. Accordingly, by using the color display member 80 having the rigidity, the assembling property can be improved.

As described above, in this embodiment, the memory 200 and the color display member 80 are inserted into the memory supporting portion (slit portion) 24*a* and the color display member supporting portion (slit portion) 24*b*, respectively, of the driving-side cover member 24. Thereafter, only by mounting the driving-side cover member 24 to the cleaning container 29, the movement of the positions of the memory 200 and the color display member 80 is prevented. As a result, the cartridge electrical contact is prevented from being covered with the fixing portion melted by the thermal caulking, and therefore a distance between the fixing portion and the cartridge electrical contact can be shortened. Accordingly, the memory 200 can be downsized.

Further, a constitution in which the memory 200 and the color display member 80 are prevented from movement only by mounting the driving-side cover member 24 to the cleaning container 29 is employed. For that reason, the memory 200 and the color display member 80 can be fixed easily, so that it is possible to provide an inexpensive cartridge improved in assembling property.

Further, the memory 200 in this embodiment is inserted so that the memory longitudinal direction (L1 direction in FIG. 7) and the inserting direction (arrow W direction in FIG. 13) of the memory 200 into the memory supporting portion (slit) 24*a* through the open portion 24*a*7 are the same direction. As a result compared with the case where the memory 200 is inserted in the widthwise (short) direction, the movement is prevented in a longer region, and therefore tilt of the memory 200 can be prevented with high accuracy. Accordingly, the electrical contacts 200*b* and 200*c* of the memory 200 can be made smaller than the main assembly electrical contact 90, and therefore the memory 200 can be downsized.

The memory supporting portion 24*a* and the color display member supporting portion 24*b*, and the memory preventing surface 29*a* and the color display member preventing surface 29*b* can be provided on the driving-side cover member 24 and the cleaning container 29, respectively, relative to each other. That is, in this embodiment, the memory supporting portion 24*a* and the color display member supporting portion 24*b* of the driving-side cover member 24 are provided at the open portions 24*a*7 and 24*b*7, respectively, of the driving-side cover member 24 at the inside of the cartridge P with respect to the longitudinal direction, but the present invention is not limited thereto.

For example, a constitution in which the open portions are provided at an outside portions of the cleaning container 29 with respect to the longitudinal direction of the cartridge P and then the memory 200 and the color display member 80 are slid and inserted from the longitudinal outside of the cleaning container 29 and in which the preventing surfaces are provided to the driving-side cover member 24 may also be employed. Also in this constitution, a similar effect can be obtained. That is, a constitution in which the memory supporting portion 24*a* and the color display member supporting portion 24*b* are provided to the cleaning container 29 and in which the memory preventing surface 29*a* and the color display member preventing surface 29*b* are provided to the driving-side cover member 24 may also be employed. Also in this constitution, a similar effect can be obtained.

In this embodiment, the fixing method of the memory and the color display member was described, but the present invention is applicable to also the case where only the memory is fixed. Also in that case, the memory can be downsized, so that it is possible to provide an inexpensive cartridge improved in assembling property.

Further, in this embodiment, an example of the constitution in which the memory and the color display member are disposed on the driving side was described, but the present invention is not limited thereto. The memory and the color display member may also be disposed on the non-driving side. Also in this constitution, a similar effect can be obtained.

[Second Embodiment]

Figure 17:
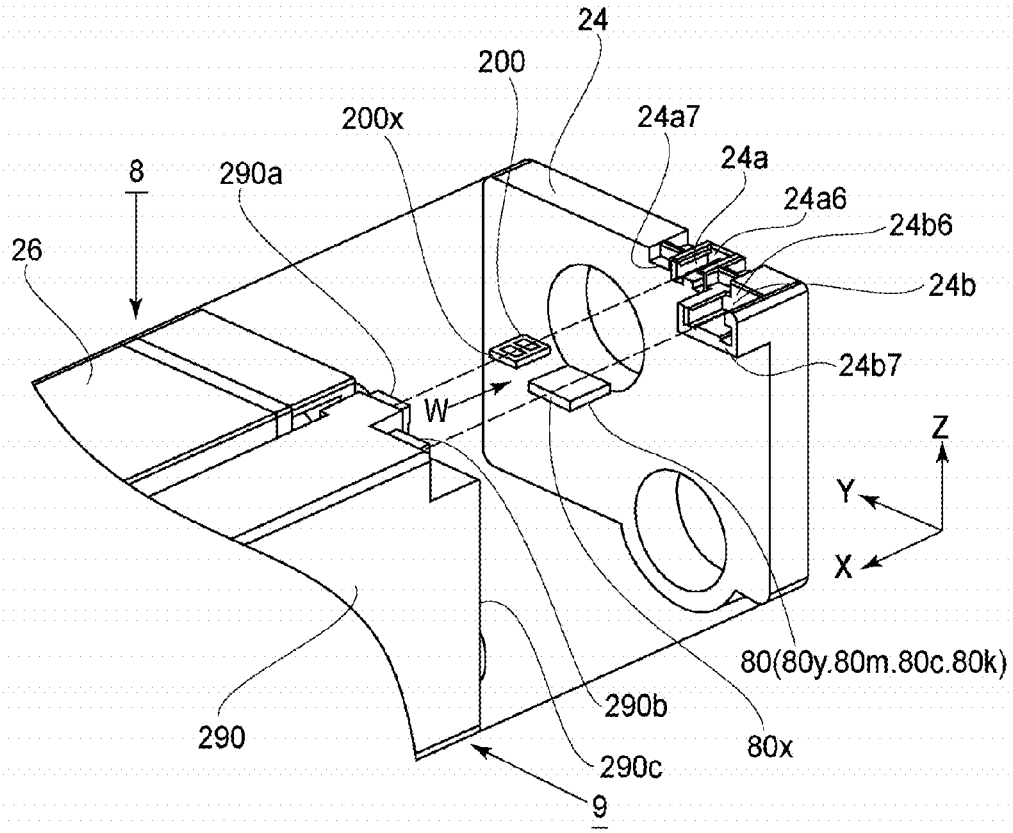
FIG. 17 is an exploded perspective view of a principal part of the cartridge in Second Embodiment.
Figure 18:
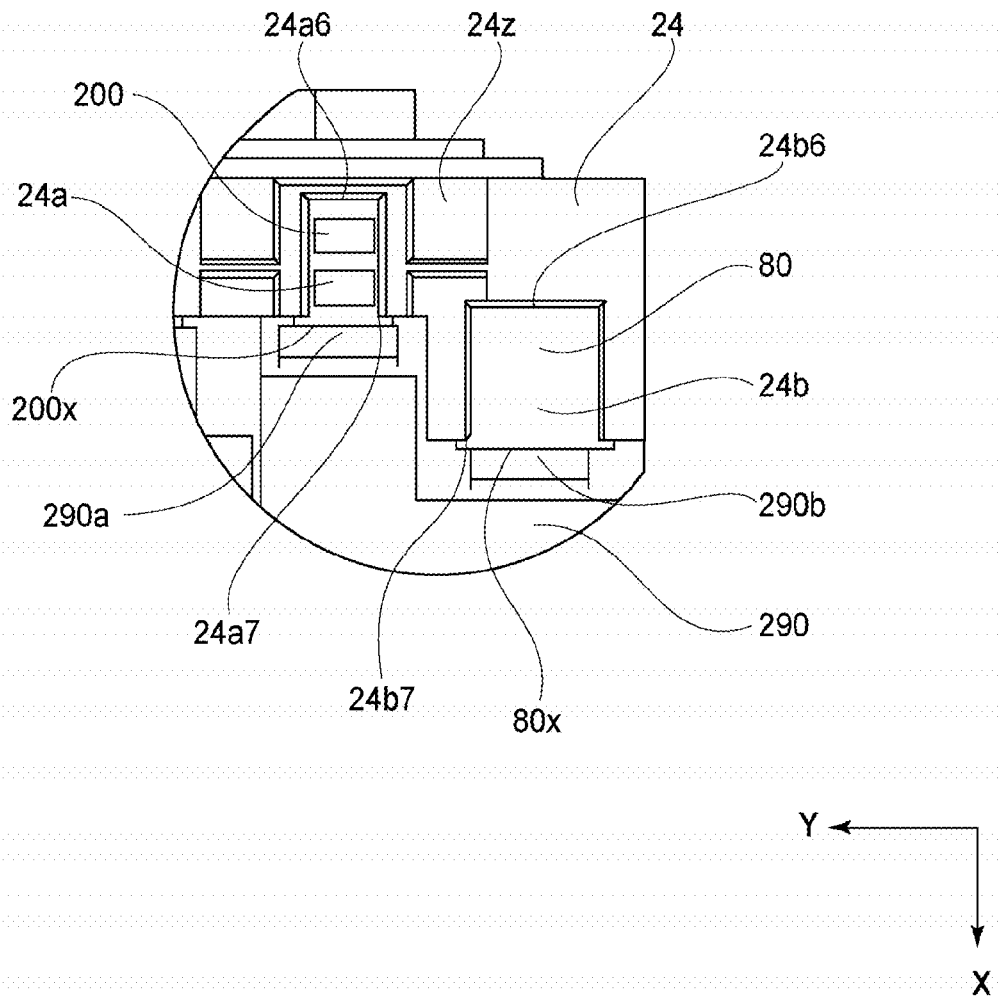
FIG. 18 is an illustration showing a state in which a memory and a color display member are assembled in Second Embodiment.

A cartridge in Second Embodiment according to the present invention will be described with reference to FIGS. 17 and 18. FIG. 17 is an exploded perspective view showing an example of a structure of a memory 200 and a color display member 80 in this embodiment, and FIG. 18 is an illustration showing an assembled state of the memory 200 and the color display member 80 in this embodiment. Incidentally, in this embodiment, a constitution and an operation which are different from those in First Embodiment described above will be described. Members or portions having the same constitutions and functions as those in First Embodiment are represented by the same reference numerals or symbols, and the description in First Embodiment will be also applied to this embodiment.

In First Embodiment, the constitution in which the driving-side cover member 24 is mounted to the cleaning container 29 after the memory 200 and the color display member 80 are inserted into the memory supporting portion 24*a* and the color display member supporting portion 24*b*, respectively, of the driving-side cover member 24, thereby to prevent the movement of the positions of the memory 200 and the color display member 80 was described. In this embodiment, a cleaning container 290 has an urging shape such that the memory 200 and the color display member 80 are urged when the driving-side cover member 24 is mounted to the cleaning container 290.

Specifically, as shown in FIG. 17, on a driving-side side surface of the cleaning container 290, a memory urging portion (first preventing portion) 290*d* for urging the memory 200 when the driving-side cover member 24 is mounted and a color display member urging portion (second preventing portion) 290*a* for urging the color display member 80 when the driving-side cover member 24 is mounted are provided. Each of the urging portions 290*a* and 290*b* has flexibility (elasticity) and is constituted integrally with the cleaning container 290.

(Mounting of Memory and Color Display Member as Manufacturing Method of Cartridge)

In this embodiment, the driving-side cover member 24 on which the memory 200 and the color display member 80 are inserted in the memory supporting portion 24*a* and the color display member supporting portion 24*b*, respectively, is assembled with the cleaning container 290. As a result, as shown in FIG. 18, the urging portions 290*a* and 290*b* contact upstream free end surfaces 200*x* and 80*x*, respectively, of the memory 200 and the color display member 80 with respect to the inserting direction.

At this time, the urging portions 290*a* and 290*b* have flexibility, and therefore are flexed (bent) in predetermined amounts with respect to an arrow X direction by being urged by the memory 200 and the color display member 80, respectively, during assembling of the driving-side cover member 24. As a result, predetermined urging forces are applied from the urging portions 290*a* and 290*b* to the memory 200 and the color display member 80, respectively. As a result, the memory 200 is urged against a surface 24*a*6 opposite from an open portion 24*a*7 of the driving-side cover member 24, so that movement of the position of the memory 200 with respect to the arrow X direction is prevented.

Similarly, the color display member 80 is urged against a surface 24*b*6 opposite from an open portion 24*b*7 of the driving-side cover member 24, so that movement of the position of the color display member 80 with respect to the arrow X direction is prevented.

(Memory Inserting Direction)

Also in this embodiment, similarly as in First Embodiment, the memory 200 is inserted so that the memory longitudinal direction (L1 direction in FIG. 7) and the inserting direction (arrow W direction in FIG. 13) of the memory 200 into the memory supporting portion (slit) 24*a* through the open portion 24*a*7 are the same direction. For that reason, compared with the case where the memory widthwise (short) direction (L2 direction in FIG. 7) and the inserting direction (arrow W direction in FIG. 13) in which the memory 200 is inserted in the open portion 24*a*7, the movement is prevented in a longer region, and therefore tilt of the memory 200 can be prevented with high accuracy. Accordingly, an outer configuration of the memory 200 can be made smaller than the main assembly electrical contact 90, or the electrical contacts 200*b* and 200*c* of the memory 200 can be made smaller than the main assembly electrical contact 90, and therefore the memory 200 can be downsized.

(Summary of Cartridge in this Embodiment)

A constitution of the cartridge in this embodiment is summarized as follows. The driving-side cover memory 24 as the memory supporting means is mounted to the cleaning container 290 functioning as a frame for holding the process means. The movement of the memory 200 and the movement of the color display member 80 are prevented, when the memory supporting means 24 is mounted to the cleaning container 290, by the urging portions 290*a* and 290*b* having flexibility provided on the cleaning container 290.

In this way, the cleaning container 290 has an urging shape as described above, so that the movement of the positions of the memory 200 and the color display member 80 with respect to the arrow X direction can be prevented with no play, and therefore this embodiment is effective in the case where the positions of the memory 200 and the color display member 80 are regulated with high accuracy.

As described above, also in this embodiment, a constitution in which the movement of the position of the memory 200 is prevented by mounting the driving-side cover member 24 to the cleaning container 290 is employed. Further, the constitution in which the memory longitudinal direction (L1 direction in FIG. 7) and the inserting direction (arrow W direction in FIG. 13) of the memory 200 into the memory supporting portion (slit) 24*a* through the open portion 24*a*7 coincide with each other is employed. Accordingly, similarly as in First Embodiment, the memory 200 can be downsized, and it is possible to provide an inexpensive cartridge which is easy to fix the memory 200 and the color display member 80 thereto with high accuracy.

Further, a constitution in which the memory 200 and the color display member 80 are prevented from movement only by mounting the driving-side cover member 24 to the cleaning container 290 is employed. For that reason, the memory 200 and the color display member 80 can be fixed easily, so that it is possible to provide an inexpensive cartridge improved in assembling property similarly as in First Embodiment.

Further, also in this embodiment, in the case where the cartridge P is recycled or in the case where there is an inconvenience of the memory 200 if any, it is possible to simply perform dismounting and exchange of the memory 200 without damaging (breaking) the components. Accordingly, similarly as in First Embodiment, it is possible to provide the cartridge having good recycling efficiency and good operation efficiency of the memory exchange.

Also in this embodiment, a constitution in which the memory supporting portion 24*a* and the color display member supporting portion 24*b* are provided to the cleaning container 290 and in which the memory urging portion 290*a* and the color display member urging portion 290*b* are provided to the driving-side cover member 24 may also be employed. Also in this constitution, a similar effect can be obtained.

(Modified Embodiments)

The present invention is not limited to First and Second Embodiments, but can also be variously modified and changed.

(Modified Embodiment 1)

In the above-described embodiments, an example in which the cartridge detachably mountable to the cartridge mounting portion of the apparatus main assembly of the image forming apparatus for forming the image on the recording material is the process cartridge is principally described, but the cartridge may also be the developing cartridge. Further, the cartridge may also be the developer cartridge. Further, the type of the process cartridge is not limited to the integral type, but may also be the separation type.

(Modified Embodiment 2)

In the above-described embodiments, the image forming apparatus of the electrophotographic image forming type was described, but the type of the image forming apparatus is not limited thereto. For example, the type may also be the electrostatic recording image forming type using the electrostatic dielectric member as the image bearing member or the magnetic recording image forming type using the magnetic recording (magnetic) material as the image bearing member. Further, the image forming apparatus is not limited to the image forming apparatus of the intermediary transfer type, but may also be an image forming apparatus of the type in which the developer image formed on the image bearing member is directly transferred onto the recording material S. The image forming apparatus may also be a monochromatic image forming apparatus.

According to the present invention, the memory can be fixed without using the thermal caulking, and therefore it is possible to provide a cartridge capable of downsizing the memory, an image forming apparatus including the cartridge, and a manufacturing method of the cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-027451 filed on Feb. 16, 2015 which is hereby incorporated by reference herein in its entirety.

What is claimed is:

1. A cartridge used for forming an image on a recording material, the cartridge comprising:

a memory for storing information, wherein the memory has an outer configuration having a length in a first direction and a length in a second direction longer than the length in the first direction in a plane crossing a thickness direction thereof;

a first cartridge constituent member;

a second cartridge constituent member for supporting an image bearing member;

a supporting portion provided on the second cartridge constituent member and provided with a slit for permitting the memory to be inserted in an inserting direction; and a preventing portion, provided on the first cartridge constituent member, for preventing movement of the memory inserted in the supporting portion, wherein a prevention width of the slit with respect to a direction crossing the thickness direction of the memory is longer than the length of the memory in the first direction and is shorter than the length of the memory in the second direction as seen in the inserting direction of the memory, and wherein the slit regulates movement of the memory in the thickness direction and is contactable to both sides of the memory in the thickness direction.

2. A cartridge according to claim 1, wherein the inserting direction of the memory and the second direction are the same direction.

3. A cartridge according to claim 1, wherein the memory is provided with a pair of electrical contacts arranged in the second direction.

4. A cartridge according to claim 1, wherein the slit is open toward the first cartridge constituent member.

5. A cartridge according to claim 1, wherein the second cartridge constituent member includes a portion-to-be-urged for receiving an urging force from an apparatus main assembly in the thickness direction of the memory and a portion-to-be-positioned where the memory is positioned relative to the apparatus main assembly by the urging force.

6. A cartridge according to claim 5, further comprising a color display member for displaying color information of developer, wherein in the plane crossing the thickness direction, with respect to the inserting direction of the memory, the memory is disposed closer to an end portion side than the color display member is disposed to the end portion side.

7. A cartridge according to claim 5, wherein the urging force from the apparatus main assembly generates by electrical connection of a main assembly electrical contact of the apparatus main assembly with the memory.

8. A cartridge according to claim 1, further comprising a developer carrying member for supplying the developer to the image bearing member on which a latent image is to be formed, and a developer accommodating portion in which the developer is accommodated.

9. A cartridge according to claim 1, wherein a latent image is formed on the image bearing member.

10. A cartridge according to claim 1, wherein the preventing portion has flexibility.

11. An image forming apparatus comprising:

a cartridge according to claim 1;

mounting means for detachably mounting the cartridge;

feeding means for feeding a recording material; and a main assembly electrical contact for being electrically connected with the memory.

12. A cartridge according to claim 1, wherein the slit regulates movement of the memory in the second direction and is contactable to both sides of the memory in the second direction.

13. A cartridge used for forming an image on a recording material, the cartridge comprising:

a memory, provided with a plurality of electrical contacts, for storing information;

a first cartridge constituent member;

a second cartridge constituent member for supporting an image bearing member;

a supporting portion provided on the second cartridge constituent member and provided with a slit for permitting the memory to be inserted in an inserting direction; and a preventing portion, provided on the first cartridge constituent member, for preventing movement of the memory inserted in the supporting portion, wherein the plurality of electrical contacts are provided and arranged along a longitudinal direction of the cartridge, and wherein the slit regulates movement of the memory in the thickness direction and is contactable to both sides of the memory in the thickness direction.

14. A cartridge used for forming an image on a recording material, the cartridge comprising:

a memory, provided with a plurality of electrical contacts, for storing information;

a first cartridge constituent member;

a second cartridge constituent member for supporting an image bearing member;

a supporting portion provided on the second cartridge constituent member and provided with a slit for permitting the memory to be inserted in an inserting direction; and a preventing portion, provided on the first cartridge constituent member, for preventing movement of the memory inserted in the supporting portion, wherein a prevention width of the slit with respect to a direction crossing the thickness direction of the memory is longer than the length of the memory in the first direction and is shorter than the length of the memory in the second direction as seen in the inserting direction of the memory, and wherein the second cartridge constituent member is a side wall member, and the first cartridge constituent member is a container for accommodating developer.

15. A manufacturing method of a cartridge used for forming an image on a recording material including, a memory for storing information, wherein the memory has an outer configuration having a length in a first direction and a length in a second direction longer than the length in the first direction in a plane crossing a thickness direction thereof;

a first cartridge constituent member;

a second cartridge constituent member for supporting an image bearing member;

a supporting portion provided on the second cartridge constituent member and provided with a slit for permitting the memory to be inserted in an inserting direction; and a preventing portion, provided on the first cartridge constituent member, for preventing movement of the memory inserted in the supporting portion, wherein a prevention width of the slit with respect to a direction crossing the thickness direction of the memory is longer than the length of the memory in the first direction and is shorter than the length of the memory in the second direction as seen in the inserting direction of the memory, and the slit regulates movement of the memory in the thickness direction and is contactable to both sides of the memory in the thickness direction, the manufacturing method comprising:

inserting the memory into the slit; and assembling the first and second cartridge constituent members with each other.

16. A manufacturing method according to claim 15, wherein the preventing portion has flexibility.

* * * * *